United States Patent [19]

Morgenroth

[11] 4,323,521

[45] Apr. 6, 1982

[54] CONSTANT DEPRESSION CARBURETOR

[76] Inventor: Henri Morgenroth, 3090 Hidden Valley La., Santa Barbara, Calif. 93108

[21] Appl. No.: 217,666

[22] Filed: Dec. 18, 1980

[51] Int. Cl.[3] ..... F02M 7/22

[52] U.S. Cl. ..... 261/50 A; 261/DIG. 38; 261/DIG. 39; 261/65

[58] Field of Search ..... 261/50 A, 44 C, 44 B, 261/DIG. 39, 65, DIG. 38

[56] References Cited

U.S. PATENT DOCUMENTS

| | | | |
|---|---|---|---|
| 1,586,683 | 6/1926 | Mock | 261/50 A |
| 1,683,634 | 9/1928 | Taylor | 261/50 A |
| 1,706,557 | 3/1929 | Baumgardner et al. | 261/50 A |
| 1,773,290 | 8/1930 | Waite | 261/50 A |
| 1,875,557 | 9/1932 | Brown | 261/44 B |
| 1,995,587 | 3/1935 | Schuttler | 261/50 A |
| 3,147,320 | 9/1964 | Tubb | 261/50 A |
| 3,198,497 | 8/1965 | Mennesson | 261/50 A |
| 3,198,498 | 7/1965 | Mennesson | 261/144 |
| 3,432,152 | 3/1969 | Sweeney | 261/50 A |
| 3,653,642 | 4/1972 | Lawrence | 261/44 C |
| 3,684,257 | 8/1972 | Lawrence | 261/44 C |
| 3,855,974 | 12/1974 | Mayer | 261/44 C |
| 3,956,434 | 5/1976 | Dickensheets et al. | 261/44 C |
| 4,008,298 | 2/1977 | Quantz | 261/44 B |

FOREIGN PATENT DOCUMENTS

| | | | |
|---|---|---|---|
| 528555 | 5/1954 | Belgium | 261/50 A |
| 1310888 | 10/1962 | France . | |
| 119180 | 9/1918 | United Kingdom | 261/50 A |
| 2033482 | 5/1980 | United Kingdom . | |

*Primary Examiner*—Tim R. Miles

*Attorney, Agent, or Firm*—Lon H. Romanski

[57] ABSTRACT

A constant depression carburetor is shown as having an induction passage with an air inlet end and a fuel-air mixture outlet end, a fuel-air mixing region is situated generally between the inlet and outlet ends, a fuel metering orifice for discharging metered fuel into the mixing region, a first throttle valve in the induction passage upstream of the fuel metering orifice, a second throttle valve in the induction passage downstream of the fuel metering orifice, a metering rod extending through the induction passage and cooperating with the fuel metering orifice to thereby variably determine the effective metering area thereof, a pressure responsive member is operatively connected to the metering rod for adjustable positioning thereof in response to sensed pressure variations in the mixing region, and connecting elements operatively interconnecting the metering rod with the pressure responsive member and the first throttle valve for assuring unified movement thereamong while providing for free angular and translational movement of the metering rod.

56 Claims, 23 Drawing Figures

CONSTANT DEPRESSION CARBURETOR

FIELD OF THE INVENTION

Generally, this invention relates to carburetors for combustion engines and more particularly to those carburetors which generate a generally constant metering pressure differential as across the fuel metering orifice means.

BACKGROUND OF THE INVENTION

Generally, it is known in the art that a constant depression (C.D.) carburetor, in principle, seeks to achieve five goals; that is, high fuel metering accuracy, elimination or at least substantial reduction in the lag in change in fuel flow rates at transient conditions, elimination of the problems attendant the changing of the fuel metering function from one to another metering orifice as is the usual case in fixed metering orifice-fixed venturi carburetors, the use of a basically simple single metering orifice for providing the entire range of required metered fuel flows and the attainment of the power capacity of staged fixed orifice carburetors by means of only a single induction passage or barrel.

The prior art C.D. carburetors, however, exhibit some disadvantages. For example, in the prior art C.D. carburetors of the slide-piston metering rod and diaphragm type the relatively large size and weight of the piston-diaphragm (or stepped piston) device present, among other problems, the problem of inertia. Also, the high dimensional accuracies of such piston devices result in high manufacturing costs. Further, the prior art C.D. carburetors employing such slide pistons are confronted with problems of friction. That is, the slide piston is usually subjected to a transverse pressure differential resulting in a sideways force being exerted on the piston which, in turn, causes frictional forces and a related hysteresis. The thusly generated hysteresis, in turn, results in slightly differing axial positions of the piston, for a given rate of air flow, depending upon whether the piston is moving toward a position of greater rate of metered fuel flow or a position of reduced rate of metered fuel flow.

The prior art has attempted to solve the problems of the slide piston type C.D. carburetor. That is, the prior art has suggested that the slide piston should be replaced as by an air baffle, variable venturi arrangement or by means of a second upstream throttle valve with such being coupled to the metering rod and a vacuum piston or diaphragm as by means of related linkages. It was believed that such, because of their ability to be held by journals or pivots, would result in far less friction, under actual operation, than the slide piston.

However, such attempts by the prior art have not proven to be successful. That is, generally, the friction reducing advantages of such elements, resulting from having them mounted in or suspended by bearings becomes lost due to the complicated connection thereof to the metering rod and the related pressure responsive diaphragm. That is, such prior art attempts have resulted in the employment of shafts, bellcranks, connecting rods and multiple bearings in order to achieve coupling of the throttle to the metering rod and to the pressure responsive diaphragm by way of tortuous friction-creating circuitous paths. Further, such connecting means of the prior art devices have to pass through as well as between different pressure regions thereby making the use of friction creating seals necessary.

In those C.D. carburetors of the prior art employing what may be considered as simple interiorly disposed linkage means between the C.D. throttle and metering rod, two different solutions are employed for operatively connecting the third member of the trinity of the elements of the C.D. carburetor, namely, the C.D. diaphragm or piston means, for conjoint operation. The first of such two solutions was to use complicated and heavy externally situated linkages between the C.D. throttle and the C.D. diaphragm or piston. However, such a connection to the C.D. diaphragm or piston still results in the undesired friction caused by the many attendant bearings and seals. The second of such two solutions was to eliminate the C.D. piston or diaphragm and to replace the function thereof with an unbalanced eccentrically suspended C.D. throttle. In such devices the suction or vacuum created downstream of the unbalanced C.D. throttle produced the effect of a separate piston directly on the C.D. throttle by, in effect loading one side of the throttle more than the other side. However, such an attempt by the prior art has not been successful. For example, the effective vacuum or suction-subjected area of such unbalanced throttles diminishes with increased opening thereof thereby resulting in difficulties in operation where increased throttle opening is required as well as being unable to maintain a sufficient degree of constant depression characteristics over the required range of operation. Another important difficulty arises from the fact that the unbalanced throttle is highly susceptible to the pulsations of the air flow. With C.D. diaphragm carburetors such air flow pulsation is a very small, if at all significant, problem. In those C.D. carburetors having a throttle connection to the C.D. diaphragm, the problem of air flow pulsations is inherently reduced to not more than a tolerable amount. However, with the unbalanced C.D. throttle of the prior art, no pneumatic damping or smoothing of air flow pulsations is possible.

The invention as herein disclosed and claimed is primarily directed to the solution of the aforestated as well as other related and attendant problems.

SUMMARY OF THE INVENTION

A carburetor, according to the invention, for a combustion engine, comprises body means, induction passage means formed by said body means, said induction passage means comprising a relatively upstream air inlet end, a relatively downstream outlet end, a fuel-air mixing region situated generally downstream of said inlet end and upstream of said outlet end, a fuel metering orifice effective for discharging fuel into said fuel-air mixing region, first throttle valve means in said induction passage means generally upstream of said fuel-air mixing region, second throttle valve means in said induction passage means generally downstream of said fuel-air mixing region, a contoured metering rod extending through said induction passage means and cooperating with said fuel metering orifice to thereby variably determine the effective metering area of said metering orifice, pressure responsive means operatively connected to said metering rod for adjustably positioning said metering rod with respect to said metering orifice in response to sensed pressure variations generally in said fuel-air mixing region, and connecting means operatively interconnecting said first throttle valve means said metering rod and said pressure responsive means for enabling the movement of said first throttle valve means said metering rod and said pressure responsive means in unison while permitting transverse movement of said metering rod relative to said first throttle valve means.

An object of the invention is to provide a low hysteresis throttle valve type C.D. carburetor.

Another object of the invention is to provide a throttle valve type C.D. carburetor which does not require the use of friction-creating seals between regions of different pneumatic pressures.

A further object of the invention is to provide a C.D. carburetor having a C.D. throttle, metering rod and C.D. diaphragm or piston which are all operatively coupled to each other by interiorly disposed linkage means as to assure conjoint operation thereof with such coupling being achieved with means of low inertial masses and a minimum of airodynamic resistance.

A still further object of the invention is to eliminate, or at least substantially reduce, any requirement for the provision of damping means for the C.D. piston as presently required by the prior art wherein when the power throttle is suddenly opened the C.D. piston tends to overshoot its proper new opening position thereby creating, during the oscillation, a momentary leaning-out of the resulting fuel-air mixture.

Yet another object of the invention is to effectively extend the low engine R.P.M. full throttle range downwards. This being especially useful in single cylinder engine applications with large valve overlap (as in motorcycles) wherein, with prior art structures, the wide open throttle low R.P.M. operation is severely limited by excessive enrichment of the mixture caused as by an additional mixture formation from the reverse mixture flow conditions occuring during the period of valve overlap.

Other general and specific objects, advantages and aspects of the invention will become apparent when reference is made to the following detailed description considered in conjunction with the accompanying drawings.

BRIEF DESCRIPTION OF THE DRAWINGS

In the drawings, wherein for purposes of clarity certain details and/or elements may be omitted from one or more views:

FIGS. 22 and 23 illustrate, in cross-sectional form, another arrangement for operatively inter-connecting the metering rod to the pressure responsive means and C.D. throttle with FIG. 22 being taken generally on the plane of line 22—22 of FIG. 23 and looking in the direction of the arrows while FIG. 23 is taken generally on the plane of line 23—23 of FIG. 22 and looking in the direction of the arrows.

DETAILED DESCRIPTION OF THE PREFERRED EMBODIMENT

Figure 1:
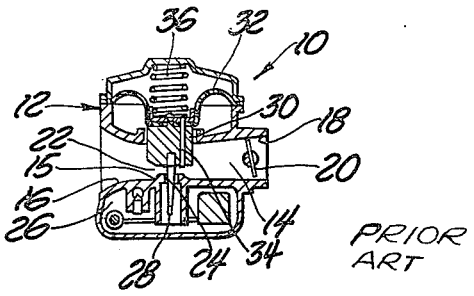
FIG. 1 is a generally longitudinal cross-sectional view, somewhat simplified, of a slide piston type C.D. carburetor of the prior art.

Referring now in greater detail to the drawings, FIG. 1, in simplified form, illustrates a prior art C.D. carburetor 10 having a carburetor body or housing 12 with an induction passage 14 formed therethrough having an air inlet end 16 and a fuel-air mixture discharge or outlet end 18 with a manually variably positionable throttle valve 20 therein downstream of the fuel-air mixing region 22. A fuel metering orifice 24, communicating with a source of fuel, as with fuel bowl chamber 26, serves to discharge fuel into the induction passage fuel-air mixing region 22. A variably positionable metering rod 28, carried and positioned as by a piston or flatted slide 30, serves to cooperate with the fuel metering orifice 24 to thereby establish a particular effective metering area in said fuel metering orifice 24. The vacuum generated in the area of the fuel-air mixing region is communicated to the upper side of a pressure responsive movable diaphragm 32 as by passage means 34. A spring 36 normally urges the slide 30, diaphragm 32 and metering rod 28 downwardly to a more nearly closed position. However, as should be evident and as is well known in the art, the opposed forces of the vacuum on diaphragm 32 and the force of spring 36 result in, theoretically, the metering rod 28 being moved to a specific position relative to the metering orifice 24 for each magnitude of air flow through the induction passage 14.

Figure 2:
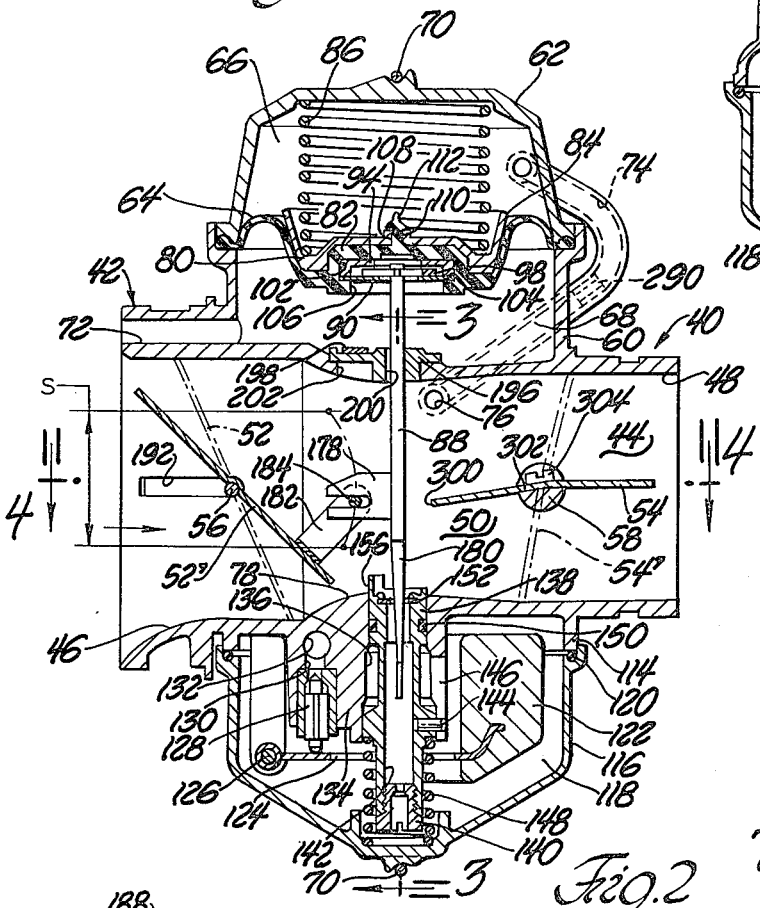
FIG. 2 is a generally longitudinal cross-sectional view of a carburetor employing teachings of the invention.

FIG. 2 illustrates a C.D. carburetor 40 of the invention as comprising carburetor body or housing means 42 having induction passage means 44 formed therethrough having an air inlet end 46 and a fuel-air mixture discharge or outlet end 48 with a fuel-air mixture region 50 generally therebetween. First throttle valve means 52 is provided in the induction passage 44 generally upstream of the mixing region 50 while second throttle valve means 54 is provided in the induction passage 44 generally downstream of the mixing region. Throttle valve means 52 is fixedly secured to related throttle valve shaft means 56 suitably journalled for rotation as about its centerline. Similarly, throttle valve 54 is fixedly secured to related throttle shaft means 58 also suitably journalled for rotation as about its centerline. Suitable linkage and/or motion transmitting means (not shown but well known in the art) serves to operatively interconnect throttle shaft 58 to related operator control means thereby enabling the selective opening and closing of the power throttle valve means 54.

A generally cylindrical wall 60 forms an extension which, in turn, cooperates with a cover or cap member 62 to peripherally contain and retain a pressure responsive movable wall means or diaphragm means 64 therebetween as to define variable chambers 66 and 68. The cover member 62 may be secured in assembled fashion, as generally depicted, as by means of a spring-type clip or retainer 70. Chamber 68 is vented to the atmosphere as via conduit or passage means 72 while chamber 66 is placed in communication with the pressure within the mixing region 50 as by conduit or passage means 74. Preferably, conduit means 74 has its end 76 situated as to downstream of the throat of a venturi section 78 preferably situated in the induction passage 44.

A generally cup-shaped spring plate or cup 80 is formed as to receive the central portion 82 of diaphragm means 64 therein. As will be further discussed, subsequently, the cup outer wall 84 is formed as to be, preferably, conical. A spring 86, situated generally in chamber 66, has one end abutting against the cap or cover 62 while the other end is seated in and against the spring cup or diaphragm backing member 80.

Figure 6:
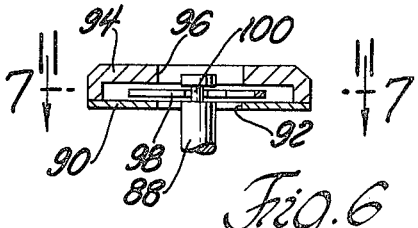
FIG. 6 is an enlarged fragmentary portion of certain of the elements shown in FIG. 2.
Figure 7:
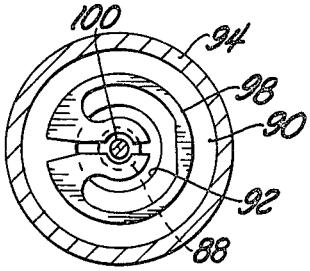
FIG. 7 is a cross-sectional view taken generally on the plane of line 7—7 of FIG. 6 and looking in the direction of the arrows.

A metering rod 88 has its upper end (as viewed in FIG. 2) operatively connected to the diaphragm means 64 by coupling means comprising a lower disposed annular plate 90 having a relatively large clearance opening 92 formed centrally thereof and an upper disposed somewhat inverted cup-like member 94 which may also be provided with a clearance opening 96. (Such elements are also illustrated in enlarged scale in FIGS. 6 and 7.) A snap-type clip retainer 98 is situated generally between the members or plates 90 and 94 as to be generally loosely confined therebetween while situated in locked but not tight engagement about a necked-down portion 100 of the metering rod 88. The clip retainer 98 has an outer diameter of such magnitude as to permit the upper end of metering rod 88 to move translationally within clearance passageway 92 while preventing the withdrawal of the clip retainer 98 through aperture 92. Further, because the clip retainer 98 is only loosely confined between upper member 94 and lower plate 90 and because the axial length of the necked-down portion 100 is significantly greater than the thickness of the clip retainer 98 and, further, because, preferably, the clip 98 even though situated about the necked-down portion 100 nevertheless does not tightly engage it, the metering rod 88 is able to experience angular motion relative to the coupling means and diaphragm means 64.

As best seen in FIG. 2, the central portion of the diaphragm means 64 is provided with a generally cylindrical chamber 102 with a lower disposed annular flange or shoulder portion 104 which tightly radially and axially contain the juxtaposed lower annular plate 90 and upper member 94 therewithin permitting the metering rod 88 to freely pass through the central aperture 106. As should be apparent, the configuration of the spring cup 80 is such as to radially confine portion 82 of diaphragm means 64 thereby assuring continued assembled relationship between the diaphragm means 64 and the connecting means operatively securing the metering rod 88 thereto while an extension 108 of the central portion of the diaphragm means 64 is pulled through a cooperating passageway 110 in spring plate or cup 80 to secure such components to each other. A head-like portion 112 prevents the unauthorized withdrawal of the extension from passageway 110.

The housing or body 42 may also be provided with a second wall-like extension 114 at its lower side (as viewed in FIG. 2) which serves to have operatively connected thereto a cup-shaped member 116 defining a fuel bowl or reservoir chamber 118. As is well known, a suitable seal 120 may be provided and the bowl member 116 may be operatively secured in assembled relationship as by, for example, an extension of the spring like retainer member 70.

As generally illustrated, the fuel reservoir assembly may be comprised of a float member 122 operatively secured to a lever arm 124 which is pivotally secured as at 126 and which is in operative engagement with a fuel inlet valve member 128 which controls the in-flow of fuel from passages 130 and 132 with passage 132 leading, ultimately, to a source of fuel. As is well known in the art, when the level or elevation of the fuel within chamber 118 attains a preselected magnitude, the float 122, through lever arm 124, serves to seat valve member 128 thereby terminating the further flow of fuel into chamber 118.

An extension 134 of body or housing 42 has a generally cylindrical passage or bore 136 formed therethrough which, in turn, receives a generally cylindrical tubular stepped member 138. The lower end of tubular member 138 has calibrated metering restriction means 140 carried thereby as to complete communication between the fuel bowl chamber 118 and the interior passage 142 of the tubular member 138. As best seen in FIG. 2, a radially enlarged portion of tubular member 138 carries a keying means, which may be in the form of a pin 144, which slidably cooperates with an axially extending slot 146 formed in extension 134. The slot 146 and pin 144 thereby cooperate to assure that the tubular member 138 will be specifically oriented during assembly. A compression spring 148, seated at its lower end as within a spring pocket formed in cup 116, has its other end seated as against the radially enlarged portion of tubular member 138 thereby continually resiliently forcing the tubular member 138 axially upwardly (as viewed in FIG. 2). The generally upper portion of tubular member 138 is provided as with annular groove means and cooperating annular sealing means 150 to thereby prevent any leakage type communication, from the fuel chamber 118 to the induction passage, as between the bore 136 and tubular member 138. As seen in each of FIGS. 2, 3 and 8, a relatively thin disc-like metering orifice plate 152 is, in sealed relationship, secured to the upper end of tubular member 138 as by, for example, spinning or peening. The orifice plate 152, in turn, is provided with a sized metering orifice 154 serving to complete communication as between induction passage means 44 and passage 142 of tubular member 138. In the preferred embodiment, the upper or inner end of tubular member 138 carries an upstanding generally arcuate baffle or deflector means 156 as, for example, shown in FIGS. 2, 3, 4, 8 and 9.

Figure 3:
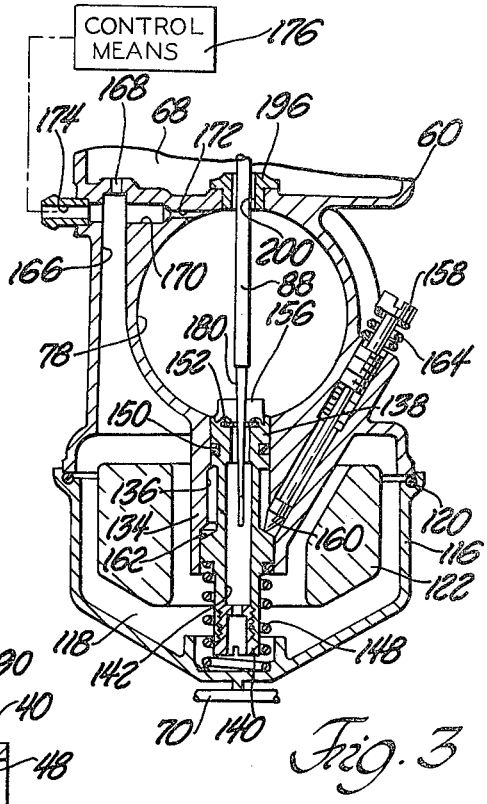
FIG. 3 is a cross-sectional view taken generally on the plane of line 3—3 of FIG. 2 and looking in the direction of the arrows.

As best seen in FIG. 3, an axially adjustable adjustment screw 158 is threadably engaged with a cooperating portion of the housing or body 42 and extends generally downwardly (as viewed in FIG. 3) as to have the lower end 160 thereof abutingly engage the generally conical annular surface 162 of the radially enlarged portion of tubular member or metering orifice holder 138. Generally, by varying the axial position of end 160 of screw 158 the longitudinal position of tubular member 138 and metering orifice means 154 is changed with such providing for adjustments in, for example, the rate of metered idle fuel flow. Spring 148 is, of course, of sufficient strength to maintain the metering orifice holder 138 in abutting engagement with adjustment screw end 160 while compression spring 164 provides the added frictional forces to preclude undesired rotation of adjustment screw 158.

In the preferred embodiment, as best depicted in FIG. 3, the housing or body 42 has a passage or conduit means 166 formed therein which has its lower end communicating with the fuel bowl chamber 118 while its upper end is in communication with chamber 68 as via calibrated passage or restriction means 168. A transverse passage or conduit means 170 comprising calibrated restriction means 172 communicates as between passage 166 and a point in the mixing region 50 of the induction passage 44 as to be in communication with the suction or vacuum pressure created in such mixing region 50. Another conduit means 174 communicates with passage 166 and is, preferably, operatively connected to related control means 176 which may take the form of, for example, thermostatically controlled valve means and/or altitude controlled valve means and/or other means responsive to indicia of engine operation.

Figure 4:
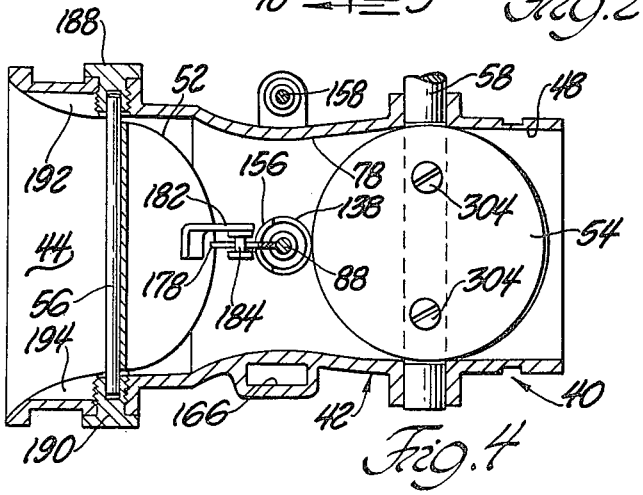
FIG. 4 is a cross-sectional view taken generally on the plane of line 4—4 of FIG. 2 and looking in the direction of the arrows.
Figure 8:
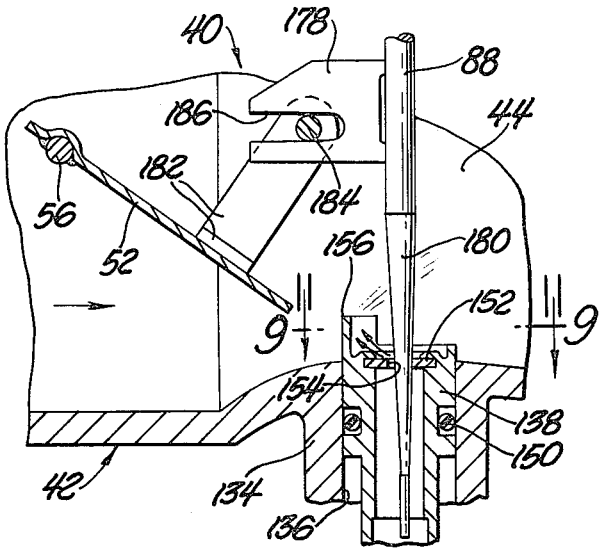
FIG. 8 is an enlarged fragmentary portion of certain of the elements shown in FIG. 2.
Figure 9:
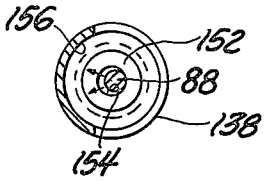
FIG. 9 is a cross-sectional view taken generally on the plane of line 9—9 of FIG. 8 and looking in the direction of the arrows.

As shown in, for example, FIGS. 2, 4 and 8, a preferably hardened thin plate 178 is suitably fixedly secured, as by for example welding, to the metering rod 88 as to be movable in unison therewith. As generally depicted in, for example, FIGS. 2, 3 and 8, the metering rod 88 has a contoured portion 180 which cooperates with metering orifice 154 to thereby define an effective metering area. An arm or lever 182 suitably secured to throttle valve 52 as by, for example, welding, carries a preferably hardened fulcrum or drive pin means 184 which is slidably received as by a slot 186 formed in plate or arm 178. Generally, as throttle valve 52 rotates the drive pin 184 will cause the metering rod 88 to move axially.

As shown in FIG. 4, the throttle shaft 56 is preferably journalled by oppositely disposed bearing members 188 and 190 each of which is preferably threadably engaged with the housing or body 42. Further, in the preferred embodiment, opposed slots, recesses or grooves 192 and 194 are formed in the induction passage 44 generally upstream of throttle shaft 56 thereby enabling both the assembly and disassembly of the throttle valve 52 and shaft 56, as a unit, to and from the carburetor body 42 after the bearing members 188 and 190 are sufficiently withdrawn with such grooves 192 and 194 functioning, of course, to provide clearance for the passage therethrough of the ends of throttle shaft 56.

As shown in, for example, FIGS. 2 and 3, a metering rod guide bushing 196 is carried by the carburetor body means 42 and retained in assembled condition as by a suitable clip-type spring 198. The guide passage 200 of bushing 196 is considerably larger than the diameter of metering rod 88 thereby permitting for a significant degree of clearance therebetween and allowing for a controlled degree of lateral and/or translational movement of the metering rod relative to the bushing 196. As best seen in FIG. 2, the bushing member 196 also serves to cover a slot 202 formed in the wall of carburetor housing 42 with such slot 202 being provided to enable, during assembly and disassembly, the withdrawal of the metering rod 88 and arm 178 secured thereto.

GENERAL OPERATION OF INVENTION

Referring to FIGS. 2–9, during periods of no air flow as during engine shut-down, the C.D. throttle 52 assumes a substantially closed position as generally depicted in phanton line at 52' and the power throttle means 54 assumes a substantially closed position as generally depicted in phantom line at 54' of FIG. 2. The C.D. throttle means 52 is brought to such position at 52' by virtue of its connection to metering rod 88, through drive pin means 184, and the fact that spring 86 is free to move metering rod 88 downwardly (as viewed in FIG. 2) to a preselected maximum position.

With the associated engine operating as at, for example, curb idle condition the power throttle valve 54 will have been rotated clockwise some small distance from its nominally closed position of 54' thereby controlling the volume rate of air flow therepast and discharging from the outlet end 48. The air flow thusly created by the associated engine and permitted by the power throttle valve 54 flows past the C.D. throttle means 52 causing the throttle 52 to move slightly toward its open position, as generally depicted in solid line in FIG. 2; in so doing, a pressure drop is experienced across the throttle 52 (upstream as compared to downstream thereof) resulting in a metering suction or vacuum being generated in the fuel-air mixing region 50. A portion of the magnitude of such metering vacuum is due to the venturi 78 in the induction passage 44. The thusly created reduced pressure in the mixing region 50 is communicated via conduit means 74 to chamber 66 causing a pressure differential to be created across pressure responsive means 64 with the result that the diaphragm means 64 moves upwardly (as viewed in FIG. 2) against the resilient resistance of spring means 86 until an equilibrium of forces is attained. In the process of thusly moving upwardly, the diaphragm means 64 also moves the metering rod 38 with it resulting in the effective metering area of metering orifice 154 increasing as to thereby permit a greater rate of metered fuel flow therethrough.

The fuel thusly metered through the effective area of metering orifice means 154 mixes with the flowing air, in the mixing region 50, and the resulting fuel-air mixture flows downstream past the partially opened power throttle 54 and is discharged, as at outlet 48, to the induction system of the associated engine.

Generally, as the power throttle 54 is further opened, the volume rate of air flow through induction passage means 44 increases causing an increase in magnitude of the metering vacuum in the mixing region 50 and, as previously explained, causing the diaphragm means 64 and metering rod 88 to move further upwardly while concomitantly further opening the C.D. throttle 52.

The fuel thusly metered is, of course, obtained from the fuel bowl or reservoir chamber 118 with such flowing upwardly through relatively large first restriction means 140 (which is not essential to the practice of the invention but is preferred), through passage 142 of metering orifice holder 138 and ultimately through the effective metering area as cooperatively determined by the metering orifice 154 and contoured portion 180 of metering rod 88.

With reference to FIG. 2, it can be seen that chamber 68 is vented to the atmosphere via conduit means 72. The venting of such atmosphere, as will subsequently become more apparent, is of such a degree as to assure that chamber 68 will always be at substantially atmospheric pressure and to that end, conduit means 72 is made sufficiently large as to, for all practical purposes, eliminate any discernable pressure drop thereacross.

With reference to FIG. 3, the ratio of the calibrated orifices or restrictions 168 and 172 will (with passage means 174 being closed) determine the pressure within the fuel bowl chamber 118 above the fuel therein. Generally, such a resulting pressure in the fuel bowl will be proportional to the then existing metering suction or vacuum in the mixing region 50. Consequently, passage 174, or more specifically the degree to which passage 174 is opened for communication with the atmosphere, will result in influencing the ultimate fuel-air ratio of the fuel-air mixture for any given conditions. Therefore, conduit or passage means 174 may be operatively connected to related control or valving means 176 the function of which is to open (and/or close) passage means 174 to atmosphere in response to indicia of engine operating conditions and parameters. For example, such control means 176 could be responsive to altitude, engine temperature and/or atmospheric temperature and even engine acceleration and deceleration to thereby appropriately alter the pressure above the fuel in fuel bowl chamber 118 and consequently modify or alter the otherwise rate of metered fuel flow through the then effective area of the metering orifice 154. Obviously, upon fully opening passage 174 to the atmosphere the greatest (absolute) pressure would be applied to the fuel in chamber 118 and the richest (in terms of fuel) fuel-air mixture would result.

OTHER EMBODIMENTS AND MODIFICATIONS

Figure 10:
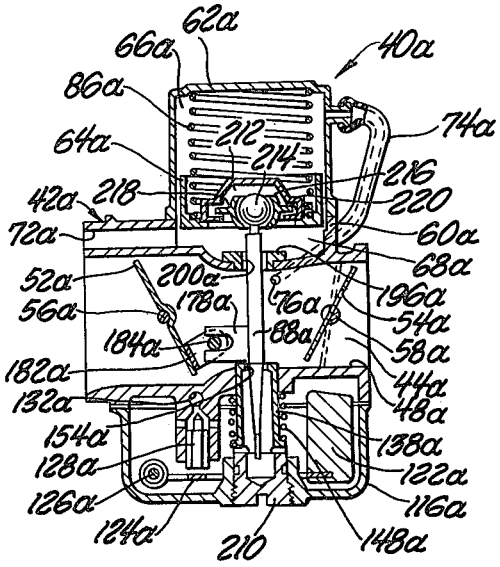
FIG. 10 is a generally longitudinal cross-sectional view of a second embodiment of the invention.

In FIG. 10 elements which are like or functionally similar to those of FIGS. 2–9 are identified with like reference numerals provided with a suffix "a". The fuel metering orifice **154*a* may be formed in a tubular member 138*a* which is continually resiliently urged downwardly, by spring means 148*a*, as against a generally conventional threadably axially adjustable stop member 210**.

In FIG. 10, the pressure responsive movable wall means comprises a piston member having a generally annular chamber 212 formed therein which accepts and cooperates with in defining a connection means for the metering rod **88*a*. In the embodiment of FIG. 10, the upper end (as viewed in FIG. 10) of metering rod 88*a* is provided with a ball-like terminal portion 214 with such being loosely contained as by a complementary cage member 216 having a radiating flange 218. A radially directed annular groove or recess 220 serves to loosely contain the flange 218 therein as to permit three degress of translational movement of the flange 218 and cage member 216 relative to the piston means 64*a***.

Figure 11:
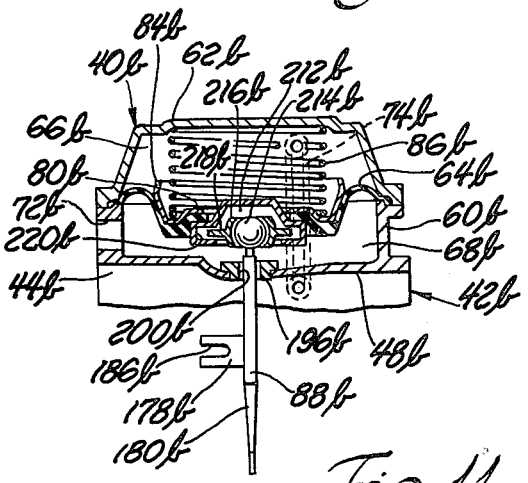
FIG. 11 is a fragmentary cross-sectional view similar in part to the structure of FIG. 10 and illustrating a further modification thereof.

In FIG. 11 elements which are like or functionally similar to those of FIGS. 2–10 are identified with like reference numerals provided with a suffix "b". In FIG. 11 only so much of the structure is illustrated as is believed necessary to illustrate the modification contemplated thereby. The body defining chamber **212*b* may be suitably secured as to the underside of diaphragm means 64*b* as by, for example, cementing or the like. As can be seen, the cup-like member 80*b* has its side wall 84*b* inclining radially outwardly generally as such wall extends axially upwardly (as viewed in FIG. 11**).

Figure 13:
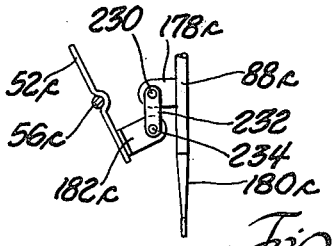
FIG. 13, in fragmentary view, illustrates another form of linkage means for operatively connecting two of the operating elements shown in, for example, FIGS. 2, 8 and 10.
Figure 14:
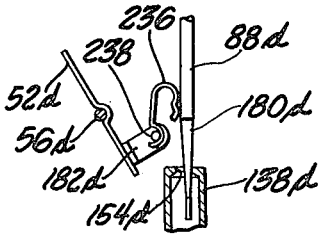
FIG. 14, in fragmentary view, illustrates another form of connecting means for operatively connecting two of the operating elements shown in, for example, FIGS. 2, 8 and 10.
Figure 15:
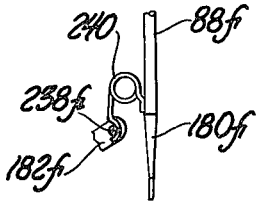
FIG. 15, in fragmentary view, illustrates still another form of connecting means for operatively connecting two of the operating elements shown in, for example, FIGS. 2, 8 and 10.

In FIGS. 13, 14 and 15 elements which are like or functionally similar to those of any of FIGS. 2–11 are identified with like reference numerals provided with suffixes "c", "d" and "f", respectively.

FIG. 13 illustrates the modified connecting means between the C.D. throttle and the metering rod **88*c* as comprising a thin plate 178*c* which, instead of a slot as at 186 of FIG. 8, carries a bearing or pivot member 230 which is operatively connected as to one end of a linkage member 232 which, in turn, has its other end pivotally connected to lever or arm 182*c* as by pivot or bearing means 234. As should be apparent the connecting means of FIG. 13 transmits axial movements of metering rod 88*c* without, in the main, transmitting side or transverse loads to and from the metering rod 88*c***.

FIG. 14 illustrates the modified connecting means between the C.D. throttle **52*d* and the metering rod 88*d* as comprising a leaf-type spring 236 operatively fixedly secured at one end to the metering rod 88*d* and pivotally secured as at its other end to a pivot-like member 238 carried as by lever or arm 182*d*. FIG. 15 illustrates a connecting means similar to that of FIG. 14 except that a wire-type torsion spring 240 is employed instead of the leaf spring 236. If desired, the one ends of such springs 236 and 240 may respectively welded to metering rods 88*d* and 88*f***.

Figure 21:
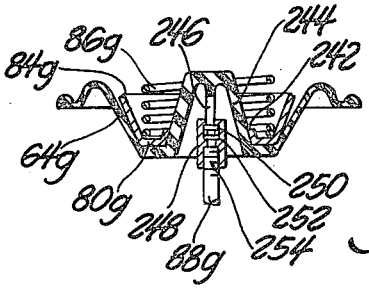
FIG. 21 illustrates, in fragmentary cross-sectional form, another arrangement for operatively coupling the pressure responsive diaphragm means to the metering rod.
Figure 22:
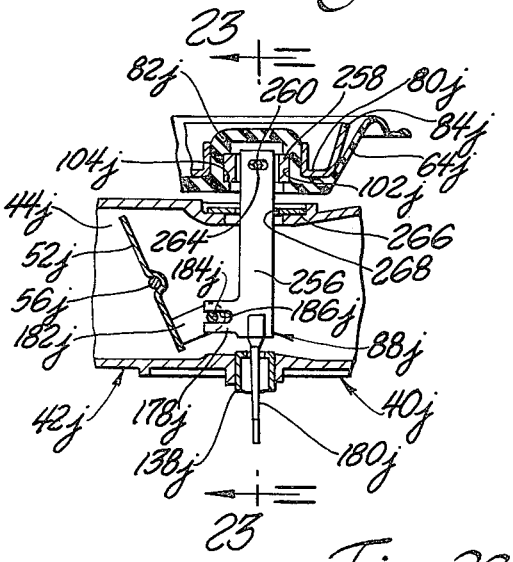
Figure 23:
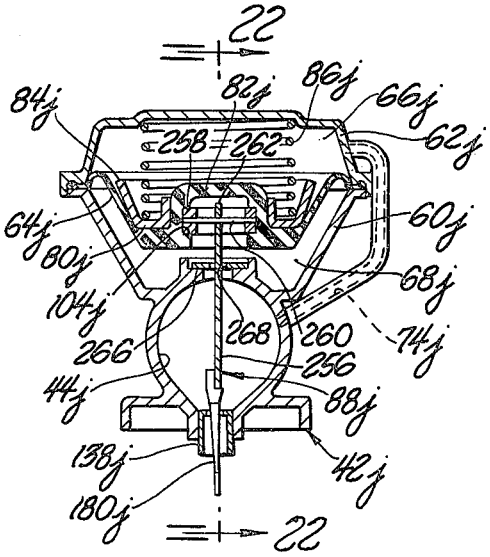

FIGS. 21, 22 and 23 illustrate other means for the interconnection of, for example, the pressure responsive wall or diaphragm means and the metering rod means. In FIG. 21 all elements like or similar to those of FIGS. 2–11 are identified with like reference numerals provided with a suffix "g". Only so much of the structure is shown in FIG. 21 as is believed necessary to illustrate the modification contemplated thereby. In the preferred form of the modification of FIG. 21, the spring cup **80*g* is provided with a centrally situated opening 242 through which extends a substantially rigid dome-like portion 244 formed in or carried by pressure responsive movable wall or diaphragm means 64*g*. Preferably, an integrally formed downwardly extending rod-like extension 246 is centrally carried by the dome-like portion 244 and is provided with a coupling member 248 which, at one end is in close engagement as with annular flanges 250 and 252 carried by extension or stem 246 and which, at its other end, is internally threaded as for threadable engagement with the upper threaded portion 254 of metering rod 88*g*. In the preferred embodiment of the modification of FIG. 21, the stem 246 is of a transverse cross-sectional area substantially less than that of metering rod 88*g* thereby assuring the elimination of any significant resistance therein to angular or sideways displacement of the metering rod 88g relative to, for example, the pressure responsive diaphragm means 64g while assuring the transmitting of axial movement as between the diaphragm means 64g and metering rod 88g**.

In FIGS. 22 and 23 all elements which are like or similar to those of FIGS. 2–11 and 21 are identified with like reference numerals provided with a suffix "j". Only so much of the structure is shown in FIGS. 22 and 23 as is believed necessary to illustrate the modifications contemplated thereby. In FIGS. 22 and 23 a modified means of interconnection between the pressure responsive movable wall means and metering rod as well as a modified form of metering rod are illustrated.

In the preferred form of the embodiments of FIGS. 22 and 23, the metering rod 88j is illustrated as being, in effect, an assembly comprised as of a lower disposed axially short contoured portion 180j suitably secured at its upper end, as by, for example, soldering or the like, to the lower end of a thin drive plate member 256 which has its upper end operatively connected to the associated pressure responsive diaphragm means 64j. Somewhat similar to FIG. 2, the diaphragm body portion 82j is provided with a chamber-like portion 102j with opposed axial end surfaces (one of which is depicted as an annular radially inwardly directed flange or shoulder surface 104j) which serve to contain a retainer or coupling ring 258 which carries a generally transversely extending connecting pin 260. As best seen in FIG. 22, the upper end portion 262 of drive plate means 256 is provided with a generally laterally (as viewed in FIG. 22) extending slot 264 which, in turn, slidably receives, therethrough, drive or connecting means 260. The inner axially extending wall of spring cup or plate means 80j, of course, serves to radially confine the diaphragm body portion 82j thereby preventing the unauthorized removal or release of the retainer means 258 from the chamber-like portion 102j. As should be evident, the plate portion 178 of, for example, FIG. 2 is made integral with drive plate means 256 as at 178j.

A guide plate 266, carried as by body means 42j, is provided with a relatively enlarged slot 268 which, in the same manner contemplated as by enlarged passage 200 of FIG. 2, accommodates the passage therethrough of the thin body portion of drive plate means 256. The combination of the elongated slot 264 and the relatively enlarged slot 268 serves to accommodate for significant angular and sideways misalignment as between the pressure responsive movable wall means 64j and the metering rod assembly 88j.

ADDITIONAL SPECIFIC BENEFITS

Internal Connection

As already disclosed and described, as with reference to, for example, FIGS. 2, 3, 4, 6–11 and 21–23, a three-way connection is achieved as among the metering rod portion 180, the C.D. throttle valve means 52 and the C.D. pressure responsive movable wall means 64 and associated spring means 86. Consequently, the throttle valve 52 through the connection with the movable wall means 64, provided via the main body portion of metering rod 88, functions to provide the same "constant depression" or vacuum in the mixing region 50 as that sought to be produced by the prior art employing the piston type slide 30 as depicted in FIG. 1. However, with the invention, the problems of the prior art are eliminated. For example, the dimensional tolerances on the various coacting elements of the invention are far less critical thereby resulting in substantial savings in costs of production; a carburetor constructed in accordance with the teachings of the invention can be of comparably reduced size and weight; the hysteresis-causing friction of the prior art structures is substantially reduced if not eliminated; and the responsiveness to changes in the load of the associated engine is dramatically increased.

The invention provides a true constant depression carburetor with all three of the elements considered essential for good constant depression metering; that is, a C.D. throttle, a metering rod and diaphragm or piston means with spring loading. The simple, airodynamically efficient linkage between the C.D. throttle and the metering rod serves as a triple connection coupling all three elements with a single device located inside the mixing region 50. It has one pivot point (as at 184 of FIG. 2) and the plate or arm 178 (FIG. 2) secured to the metering rod body or stem portion completes the triple connection as by leading downwardly to the contoured fuel metering portion 180 of the metering rod 88 and upwardly, through the same body or stem of metering rod 88 to the pressure responsive movable wall means or diaphragm means 64 as through the coupling means which may take the form as depicted in, for example, FIGS. 6 and 7.

In the embodiment of FIGS. 2, 3, 4 and 6 the drive or connecting pin 184 transmits only the axial movements of the metering rod while not interfering in the otherwise complete freedom for transverse, angular or sideways movement of the metering rod 88 thereby eliminating or substantially reducing any tendency for the occurrence of side friction of the metering rod either in the metering orifice 152 or in the guide passageway 200. Further, with such a drive or connecting means, as for example at 184, it becomes possible, if desired, to provide for the sideways biasing of the metering portion 180 within the metering orifice 152 as by the employment of light biasing spring means.

In the embodiment of FIG. 13, already discussed and described, it should be apparent that the connection means disclosed therein also transmits only axial movement of the metering rod means 88c while effectively isolating the metering rod 88c from any side or transverse loads or forces.

In the embodiments of FIGS. 14 and 15, the respective connecting means 238 and 240, each light springs but of differing configuration, are not only intended to provide for the transmitting of axial motion but also provide a calculated very slight sideways or transverse force against the metering rod as to result in a somewhat slight inclination or leaning of the metering portion (as for example 180d or 180f) of the metering rod within the cooperating fuel metering orifice (as somewhat depicted in either FIG. 14 or 8). Such a lateral or side force, induced by spring means 238 or 240, is very small in magnitude and as such does not alter the basic principle and concept of the interconnection, that being, providing for axial coupling of the C.D. throttle while permitting lateral freedom of motion of the metering rod.

Adjustable Metering Orifice and Deflector

As already generally disclosed and described as, for example, with reference to FIGS. 2 and 3, the fuel orifice metering means, comprised of tubular body portion 138 and fuel metering orifice member 152, is adjustable in the axial direction for the purpose of original positioning of the orifice 154 relative to the fixed geometry of the metering rod 88 and its contoured metering portion 180 and for the purpose of idle fuel metering adjustment. By employing an adjustment member 158, and the arrangement depicted in FIG. 3, the point at which axial adjustment of the fuel orifice metering means is affected is high above the float level of the fuel bowl assembly thereby resulting in a simple totally enclosed fuel bowl cup or housing 116 which needs only a single seal as at 120 of FIGS. 2 and 3. Further, such an arrangement permits adjustment of the fuel metering orifice means from generally above instead of from below the carburetor as is required in the conventional adjustment arrangement as depicted at, for example, 138*a* and 210 of FIG. 10 which, as should be apparent, requires additional machining to accommodate the adjustment member 210 and requires additional sealing means coacting with member 210 to prevent leakage therepast.

In the preferred form of the embodiment of FIGS. 2 and 3, the fuel metering orifice means carries a deflector means or shield 156 which serves at least two purposes. The first of such purposes relates to the axial adjustment of the metering orifice 154 while the second purpose concerns itself with an airodynamic relationship to the C.D. throttle geometry which influences the metering suction or vacuum curve. This second purpose will be explained later.

If the fuel metering orifice means (138 and 154) did not carry the deflector means 156 and were adjusted in the axial direction, the metering orifice 154 would be subjected to appreciably different magnitudes and patterns of metering suction or vacuum which exist at various distances generally radially inwardly from the wall or surface of the venturi throat 78. As a consequence thereof, in prior art constant depression type carburetors, the total range of axial adjustment of the fuel metering orifice is extremely small and such a limitation, in turn, requires very critical manufacturing tolerances in the overall carburetor in order to be able to have such extremely small adjustment range always in a metering suction or vacuum region of a constant and selected magnitude and pattern.

It has been discovered that by employing deflector means as, for example, shield means 156 that the range of axial adjustment of the metering orifice 154 can be increased by a factor of at least five times that of the prior art C.D. carburetors. For example, with the deflector shield embodiment of FIGS. 2 and 3, it has been discovered that an axial adjustment range as large as 4.0 mm, can be made and that the metering suction or vacuum curves throughout such entire adjustment range remain identical regardless of the axial position within such adjustment range to which the metering orifice 154 has been adjusted. It is believed that the reason for this is that the deflector means 156 creates a vortex which completely destroys the otherwise prevailing air-flow stratification. Such a created vortex downstream of the deflector means 156 results in the generation of the same magnitude of metering suction or vacuum regardless of the elevation to which the metering orifice 154 has been adjusted. The prior art C.D. carburetors, as generally depicted at 15 of FIG. 1, did, at times, provide a step-like portion in the area of the fuel metering orifice. However, such a prior art step, as at 15 of FIG. 1, is fixed and not capable of adjustment to in any way, in turn, provide for the enhancement of adjustability of the fuel metering orifice means as does deflector means 156.

Although not directly related to the deflector means 156, it might be best to here point out that the calibrated restriction means 140 of FIGS. 2 and 3 is not essential to the practice of the invention. However, the provision of such a second calibrated restriction means 140 (selected to the particular requirements of the associated engine) can be employed for establishing the maximum rate of metered fuel flow as would occur at, for example, wide open throttle engine operation without in any way effecting the metering accuracy of the metering rod 88 as at lower metering rates.

Free Floating Diaphragm

As was generally already stated, in conventional prior art embodiments, a diaphragm, whether in the form of a sock or provided with a deep convolution as generally depicted in FIG. 1, would always have to be provided with some form of associated guide which functions to force the diaphragm means to move in a linear direction and which also prevents tilting and sideways movement of the diaphragm. Such prior art guides, however, create friction which, in turn, results in hysteresis being introduced into the system.

In practicing the teachings of the invention, it becomes possible to have a free floating diaphragm assembly without the need for associated guide means as employed in the prior art. Further, the teachings of the invention provide means for at least greatly reducing the tendency of the diaphragm means to tilt and/or meander sideways from the desired straight line stroke. If, in a structure embodying teachings of the invention, there is any residual tendency for the diaphragm means, as 64, to tilt or experience side movement, such tendency is in effect harmlessly absorbed by the flexible lost-motion type coupling means between the diaphragm means and the metering rod as depicted in, for example, FIGS. 2, 3, 6, 7, 11, 21, 22 and 23. As previously discussed, such coupling means permit lateral and angular misalignment without transmitting any undesirable transverse forces, resulting from such misalignment, to the associated metering rod.

In the preferred form of the invention, the C.D. spring means as, for example, at 86 of FIG. 2, has a ratio of its free length to diameter as to prevent buckling thereof during use. Such spring means, in and of itself, somewhat provides a function of guiding the diaphragm means 64 in a straight line path during its movement.

With reference in particular to FIGS. 2 and 11, according to the teachings of the invention, the diaphragm means 64 is prevented from excessive tilting by the provision of the generally outwardly flared or conical wall or collar portion 84 carried as by the spring plate 80. It can be seen that as a consequence of the flared or conical wall or collar 84 the only way in which a tilting of the diaphragm means 64 and plate 80 could take place is by in effect pushing one radial side of the diaphragm convolution sideways which, of course, is contrary to the shape or conformation it naturally wants to assume under the urging of the pressure differential thereacross resulting from the vacuum within chamber 66. Consequently, it can be seen that flared or conical wall 84 contenically provides a surface against which such diaphragm convolution an act and preclude sideways movement of such convolution thereby providing for the non-tilting of the diaphragm means and providing for the straightline movement thereof without attendant friction; such friction being absent because the diaphragm convolution rolls onto and off the side of the stabilizing wall or surface means 84.

Figure 12:
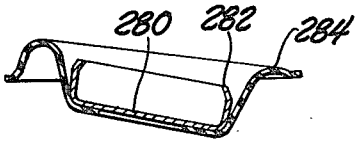
FIG. 12 illustrates another form of pressure responsive diaphragm means.

In comparing the structure of FIG. 12 wherein the spring cup or plate 280 is provided with a generally cylindrical side wall 282 (or a wall of insufficient conical configuration), it can be seen that the convolution of the diaphragm member 284 can easily be moved sideways without affecting engagement with the side wall 282 and therefore the diaphragm member 284 and the spring plate 280 (along with any other element attached thereto) can experience considerable tilting and lateral displacement.

Generally, as depicted in, for example, FIG. 2, three factors are employed by the invention, as disclosed therein, for achieving the desired free floating, no-friction, pressure responsive diaphragm means. Broadly stated these are: (a) the use of a spring 86 of sufficiently large diameter and sufficiently small free length as to prevent buckling thereof; (b) the use of an annularly flared or conical wall or collar means 84 carried as by the spring plate 80 with the angle or contour of such wall means 84 being determined, in the main, by the radius of the convolution of the diaphragm 64, and, the effective diameter of such wall means being such that the diaphragm convolution rolls thereagainst to preclude tilting; and (c) the coupling of the related metering rod to the diaphragm means in a manner providing for the accommodation of angular and sideways (lateral or transverse) misalignment as between the metering rod and the diaphragm means. Such an approach, as herein disclosed, succeeds in preserving the delicate balance between the metering vacuum or suction on the diaphragm means 64 and the counter-force of the C.D. spring 86 thereby establishing specific positions of the metering rod for respective specific operating conditions because of the elimination of friction and hysteresis as occur in the prior art structures employing slide type guide means for the positioning of the metering rod.

Metering Rod Guide

In the various embodiments and modifications of the invention, a guide-like member is employed for guiding the relatively upper portion of the associated metering rod. For example, in FIGS. 2 and 3, the guide member is shown at 196; in FIGS. 10 and 11 the guide member is depicted at 196*a* and 196*b*, respectively, and in FIGS. 22 and 23 the guide member is shown at 266. With reference to FIGS. 2 and 3, which may be considered typical for this purpose, the bushing or guide means 196 is provided with a guide opening 200 which is of a size providing clearance sufficient to permit the metering rod means 88 to assume a somewhat inclined attitude as depicted in, for example, FIG. 8. In some embodiments, as depicted in for example FIGS. 14 and 15, spring bias means may be included to assure that the metering rod means 88 will actually be against one side of the fuel metering orifice means 154. However, it has been discovered that in carburetors employing teachings of the invention the friction associated with the suspension of the metering rod means 88 was so drastically reduced to such a small magnitude that the "wind force" of the air flow, through the induction passage means 44, is sufficient to urge the metering rod means 88 against one side of the metering orifice 154 as depicted in FIG. 8.

In order to have the loose fit (between guide passage means 200 and the metering rod means 88) possible, the atmospheric connection as through passage means 72 is made large as to minimize if not totally eliminate a pressure drop through such passage means 72. By having a large ratio of the effective flow area of passage 72 to the leakage area through guide passage 200, the creation of any pressure drop within chamber 68 through the action of such leakage is avoided. The resulting small air flow which is, in effect, shunted past throttle means 52 by the leakage permitted through guide passage means 200, is totally acceptable. Consequently, as should be apparent, the use of a seal for sealing the metering rod means 88, as it passes through the wall of the induction passage means, is avoided and, still, the guide or bushing means 196 serves to separate the atmospheric pressure within chamber 68 from the metering vacuum or suction as within the mixing region 50.

Acceleration, Damping and Inertia

Prior art constant depression carburetors are not provided with acceleration pumps since such are not considered necessary. That is, compared to carburetors having non-variable fuel metering orifices wherein, often, during acceleration the fuel metering function switches as from a low speed metering orifice to a high speed metering orifice resulting in a time lag in the increased rate of metered fuel flow (such lag also being at least in part due to the requirement that such increased rate of fuel flow first be commingled with bleed-air as to form a fuel-bleed-air emulsion prior to the actual metering function), constant depression carburetors vary the effective area of the fuel metering orifice in response to changes in engine demand and thereby obviate the necessity of an acceleration pump.

In order to supply some momentary enrichment during engine acceleration, for wetting-down the induction passage means of the associated intake manifold, prior art constant depression carburetors are, often, provided with related damping means which serves to delay the opening of the C.D. piston, as depicted at 30 of FIG. 1. However, the main reason for the use of such damping means is in the attempt to correct the tendency of the relatively heavy C.D. piston slide 30 to overshoot and oscillate. That is, as previously generally indicated, in prior art constant depression carburetors, upon sudden opening of the throttle 20 (FIG. 1), an undamped piston slide 30, because of the frictional forces, first tends to lag in its response time and then moves to a point where it overshoots the position it should assume for the then operating condition. This, in turn, results in oscillations about the proper operating position causing variations in the magnitude of the metering vacuum or suction in the mixing region with attendant momentary leaning-out of the rate of metered fuel flow below that desired for proper engine operation. The prior art provided such damping means, usually hydraulic, for preventing such undesired piston slide overshoot and oscillations. However, of necessity, such damping means itself, inherently, contributes to the generation of undesired hysteresis in the system.

In contrast, the teachings of the invention make it now possible to eliminate the need of such prior art damping means. As part of such teachings, in the preferred embodiment of the invention, care and consideration is given to the creation of light-weight direct internal connecting means as among the C.D. throttle, metering rod and C.D. diaphragm as to thereby minimize inertia.

In one aspect of the invention, the spring plate or cup, as at 80 (FIG. 2), is formed of light-weight plastic material or even of light-weight aluminum. The coupling member 94 is also preferably formed of light-weight plastic; the diaphragm 64 is closed in its central portion and therefore does not need rivets or screws (which are relatively heavy) in order to hold it assembled to the coupling means as shown in, for example, FIGS. 2, 6 and 7.

The drive portion of the interconnecting linkage means (as comprised of elements 178 and 182) is preferably formed of, for example, very thin light-weight stamped metal portions.

In another aspect of the invention, the depression throttle, as at 52 of FIG. 2, is formed of thin gauge stainless steel and welded (or the like) to the throttle shaft 56 which is made of a comparably small diameter. By so doing, it becomes possible to eliminate the use of a relatively thick throttle valve and a correspondingly relatively large diameter throttle shaft as is usually required where the throttle valve is to be secured to the throttle shaft by means of screws. As a consequence the throttle shaft (as at 56) and the throttle valve (as at 52) are comparably very light in weight effectively minimizing inherent inertia. The use of removable bearings 188 and 190, of course, makes the use of such a single-piece or unified (sans screws etc.) throttle and shaft subassembly possible. Further, in the preferred embodiment of such an aspect of the invention, the throttle valve, as at 52, is formed with a diametral channel, or the like, which serves to receive or cradle the throttle shaft 56 with such shaft 56 and valve 52 then being welded to each other. The formed channel serves to provide a generally stiffening effect to the juxtaposed throttle shaft 56; further, the subassembly of joined valve 52 and shaft 56 are preferably assembled to the remainder of the carburetor assembly 40 in a manner whereby the throttle valve 52 is, generally, on the downstream side of the throttle shaft 56, as when the throttle 52 is in, for example, a closed position. As a consequence thereof, in the event an engine backfire should occur, the pneumatic force of such backfire would force the throttle valve 52 against the throttle shaft 56 and thereby prevent bending of the throttle shaft 56 because of enhanced force distribution along the shaft 56.

The invention eliminates the damping means required by the prior art piston slide arrangements. However, in those situations where it is believed necessary to provide a slight degree of damping, during initiation of engine acceleration as to wet-down the induction passage of the intake manifold, such can be provided as by the inclusion of a calibrated restriction, or the like, 290 in the vacuum passage means 74. It should be apparent that such form of damping in no way creates any undesirable frictional forces.

Improved Low Range Profile of Metering Rod

From an inspection of FIG. 1, it can be seen that in the prior art the piston slide 30 and the metering rod 28 move together in equal strokes or distances. In contrast, the C.D. throttle means (for example 52 of FIG. 2) has a changing relationship as between metering rod lift and the attendant air flow opening. (The total stroke or distance moved by metering rod means 88 being depicted by dimension "S" in FIG. 2.) The distance of movement or lift of the metering rod means 88 is, generally, proportional to the change in the angle of the C.D. throttle valve means 52. However, equal throttle angle movements do not result in equal air flow area changes. That is, in the invention, at, for example, just above idle conditions, the throttle 52 must undergo significantly more degrees of throttle angle opening movement in order to achieve the same change in the air flow area therepast as is achieved by the throttle valve 52 for an increment of opening movement near its wide open condition.

It therefore becomes possible to employ such relationships in the invention to overcome other problems of the prior art. That is, prior art C.D. carburetors have had to employ a very complicated profile or contour on the associated metering rod in the idle and slightly above idle metering range. Such prior art complicated metering rod profiles are, of course, costly to produce and the location thereof, as at assembly, to the related fuel metering orifice becomes quite critical. With the teachings of the invention it becomes possible to employ the comparably increased metering rod stroke in, generally, the idle and low off-idle range as a means for altering and simplifying the contour of the metering rod means which, from a standpoint of especially cost, ideally would be a straight line taper (conical).

Figure 18:
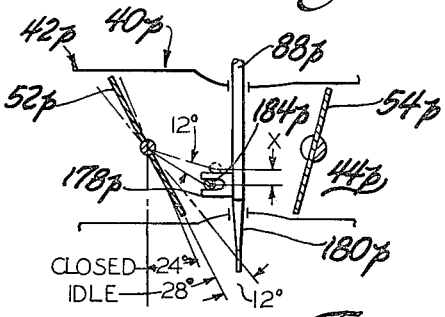
FIGS. 18, 19 and 20 are each somewhat simplified representations of structure as generally depicted in, for example, FIG. 2 with such depicting the influence of the linkage geometry on the taper or contour of the metering rod.
Figure 19:
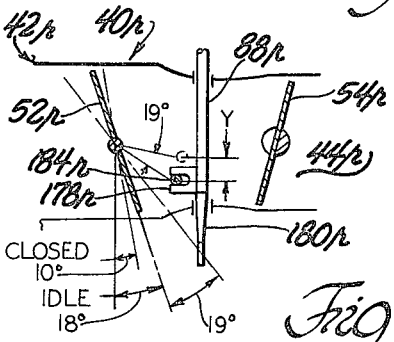

In order to better illustrate such, reference is made primarily to FIGS. 18 and 19 wherein elements like or functionally similar to any of FIGS. 2–4, 6–11, 13–15 and 21–23 are identified with like reference numerals provided with suffixes "p" and "r", respectively. In FIG. 18, let it be assumed that the C.D. throttle **52*p*, when closed, is angularly displaced from the vertical by 24° and that when opened 4° from such closed position (28° from the vertical) sufficient idle air flow is established past throttle means 52*p*. In FIG. 19, let it be assumed that the C.D. throttle 52*r*, when closed, is angularly displaced from the vertical by 10° and that when opened 8° from such closed position (18° from the vertical) sufficient idle air flow is established past throttle means 52*r*. In comparing FIGS. 18 and 19, it can be seen that the metering rod means 88*r* of FIG. 19 has moved axially approximately twice the axial movement of metering rod means 88*p* of FIG. 18 during the rotation of respective throttle valves 52*p* and 52*r* from their closed positions to their respective idle air flow positions. Therefore, it becomes apparent that the contoured portion 180*r* of metering rod means 88*r* is made "flatter" in the sense that there is less change in the profile or contour thereof for an increment of axial change in position than that, for the same increment of axial change in position, of metering rod means 88*p***.

Now, considering part throttle operation, with reference to FIG. 18 let it be assumed that the C.D. throttle **52*p* has been further rotated toward a more nearly fully opened position as by an additional 12° (total of 40° from the vertical). In FIG. 19, in order to achieve the same air flow area past throttle valve 52*r*, such throttle valve 52*r* must be rotated an additional 19° (total of 37° from the vertical). During such respective rotational movements of throttles 52*p* and 52*r*, the metering rod means 88*p* and 88*r***, respectively, moved axial distances X and Y, and, it is apparent that distance Y is significantly greater than distance X.

Accordingly, it should now be apparent that the original angle (from the vertical) of the C.D. throttle valve, when closed, influences the angle or sharpness of the profile of the contour on the metering portion 180 of the metering rod for not only the idle fuel metering range but also for the off-idle and higher part-throttle air flow metering range. Therefore, the closed angle of the C.D. throttle may be employed as another factor in determining the characteristics or contour of the metering portion 180 of the fuel metering rod means 88.

Figure 20:
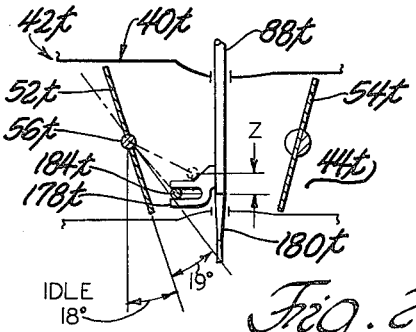

In FIG. 20 the throttle means 52*t* is situated as in FIG. 19 in that closed position is at 10° with respect to the vertical while idle air flow is attained with an additional 8° opening (total of 18° from vertical). However, in the embodiment of FIG. 20 the drive pin 184*t* is situated closer to the throttle valve 52*t* than in the arrangement of FIG. 19. This, in turn, results in the angle (as measured from the axis of drive pin 184*t* to the axis of throttle shaft 56*t* and the medial plane of throttle 52*t*) considerably less than the comparable angle of the arrangement of FIG. 19. As should now be apparent from the previous comparison of FIGS. 18 and 19, the altered relative position of the drive pin also has an influence on the relative position attained by the metering rod means 88*t* in response to angular movement of throttle valve 52*t*. For example, in comparing the distance moved by the metering rod means 88*t* (distance Z) during the time that throttle means 52*t* has moved from idle to some off-idle part throttle position (corresponding to that of throttle 52*r* when moved to its position 37° from the vertical) it can be seen that axial distance Z is less than axial distance Y. Accordingly, the position or location of the drive pin connecting means 184, relative to the C.D. throttle valve 52, provides another factor which can be employed in assisting to shape the contour or profile of the metering rod metering portion 180 into a more simplified configuration.

By employing teachings of the invention even a third influencing factor becomes available for use in the tailoring of the contour of the metering rod metering portion 180. Such third factor may be thought of as comprising an adjustably positionable metering orifice 154 and the associated deflector shield or means 156 which actually enables the positioning of the metering orifice without loss of metering vacuum or suction. It has been discovered that through the use of such factors it has been possible to achieve a metering rod metering portion having a configuration of a true cone or, at most, a cone with only minor deviations therein.

In FIG. 8 the C.D. throttle 52 is illustrated in an off-idle part throttle position causing the lower air stream to impact against the upstream surface of the shield or deflector means 156. Without the provision of such deflector or shield means 156, the air flow would be directed in the direction of and toward the fuel metering orifice 154 with the result that a substantial reduction in the magnitude of the metering vacuum or suction at the metering orifice 154 would occur, as is often the situation in prior art C.D. carburetors. In order to compensate for such loss of metering vacuum or suction, at that stage of operation, the metering portion of the metering rod would be formed to provide a reduced thickness at that axial location of the metering portion in order to increase the effective metering area to offset the loss of metering pressure. It appears that the use of such deflector or shield means presents an important means for the elimination of such leaning-out of fuel as would occur in prior art structures. Although not known for certain, it appears that such deflector or shielding means 156 prevents the leaning-out of the metered fuel by converting the effect of the impacting air stream (impacting upon means 156) into a suction or vacuum generating air stream possibly by increasing the velocity of the air as it flows around and over the shielding means 156. As a consequence of the establishment of such a shield-generated vacuum, along with the other factors already described, it has become possible to eliminate the previously described metering rod metering contour compensating for the loss of metering suction or vacuum.

Hereinbefore, the shield or deflector means 156 has been described as being a means which makes possible an idle fuel adjustment, by means of height adjustment of the metering orifice 154 because such shield means 156 makes the magnitude of the metering vacuum or suction, at the metering orifice, independent of the distance which the metering orifice is away from the induction passage venturi wall. However, now, it can be seen that such deflector or shield means 156 provides a second, and different, function which is to influence the shape or contour of the metering portion 180 of the metering rod means 88.

By way of summary, it should now be apparent that the several teachings of the invention enable the construction of a metering rod means having a metering portion profile or contour of that of a straight (right) cone or at least a nearly straight surfaced cone and that, generally, the factors employed or employable in so determining the metering rod metering portion contour are: (a) the angle of the C.D. throttle when closed; (b) the angle which the line connecting the centers of the C.D. throttle shaft and drive pin makes with respect to the medial plane of the C.D. throttle; (c) the distance between the metering orifice and the C.D. throttle and (d) the size, height and placement of the deflector shield means upstream of the metering orifice.

Compensation of Effect of Reverse Air Flow

Single cylinder engines and two-stroke engines with large port overlap exhibit a strong fuel-air mixture flow reversal during periods of valve overlap at full engine power and low engine R.P.M. At such a power setting, in the prior art C.D. carburetors, as depicted in FIG. 1, the C.D. piston slide 30 is partly closed and the reverse flow of the mixture passes under the piston slide 30 and in so doing experiences (by virtue of a venturi-like effect) an increase in velocity which, in turn, creates or generates a further increase in the metering vacuum or suction at the metering orifice. As a consequence thereof, such reverse-flowing mixture is charged with a second quantity of metered fuel from the metering orifice 24. Such "doubly charged" overly rich (in terms of fuel) mixture flows into the intake air cleaner assembly and then re-inducted toward and into the engine and, in its flow toward the engine, the already overly rich mixture is again provided with a third quantity of metered fuel as it flows past the metering orifice 24. The thusly triple fuel-charged mixture when inducted into the combustion chamber at wide open throttle low engine R.P.M. results in a still further reduction of engine R.P.M. often ultimately ending in an engine stall.

However, carburetors employing teachings of the invention eliminate such effects resulting from reverse fuel-air mixture flow.

For example, referring to FIG. 2, let it be assumed that the C.D. throttle means 52 is at the position depicted therein with the power throttle means 54 being wide open, as also depicted, and with the associated engine operating at, for example 1200 R.P.M. In this situation when the fuel-air mixture undergoes reverse flow (as because of engine valve overlap) such reversely flowing mixture becomes throttled by the C.D.

throttle means 52 causing, in effect, an impacting pneumatic compression at the metering orifice 154 which translates itself into a substantial increase in the magnitude of the absolute pressure in the induction passage means at the metering orifice 154. Such a momentary increase in the pressure prevents the metering of additional fuel to the reversely flowing fuel-air mixture and, apparently, even causes some reverse flow through the metering orifice 154. As a consequence of such momentary reverse flow through the metering orifice a delay occurs before fuel can again be metered through the fuel metering orifice and such delay presents still another benefit. That is, when the reversely flowing fuel-air mixture is again re-inducted and flows toward and to the engine, the said delay presents a sufficient time lapse which permits the re-inducted fuel-air mixture to flow past the metering orifice before fuel is again started to be metered through the metering orifice thereby precluding the charging of such re-inducted fuel-air mixture with additional fuel.

During testing it was found that under the same engine operating conditions, namely wide open power throttle and 1200 R.P.M., a C.D. carburetor according to the prior art provided a fuel-air mixture strength of 600 g.HP/hour while a carburetor employing teachings of the invention provided a fuel-air mixture strength of approximately 300 g.HP/hour. Further, with the prior art C.D. carburetor, at wide open throttle, the engine stalled at slightly less than 1200 R.P.M. while when equipped with the carburetor of the invention, the engine, at wide open throttle, continued operating down to 700 R.P.M. while still maintaining the correct rate of fuel consumption. Accordingly, this particular feature constitutes a major improvement in high gear vehicle drivability which is especially important for motorcycle engines.

Power Enrichment

In some applications it has been found that a means for power enrichment is desirable. Generally, it is well known in the art that a characteristic of C.D. carburetors is that the position assumed by the metering rod at part load high engine R.P.M. is also the position assumed by the metering rod at full engine load, low engine R.P.M. Consequently, it becomes impossible to provide a special contour on the metering rod in order to achieve an increased rate of metered fuel flow at full engine power, low engine R.P.M. because that contour is already established in order to provide the correct rate of metered fuel flow at part load high engine R.P.M. operation.

Figure 5:
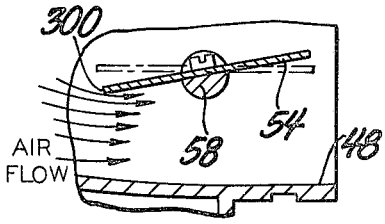
FIG. 5 is a view similar to a fragmentary portion of the structure of FIG. 2 but illustrating a power throttle of differing configurations.

As generally depicted in FIG. 1, it can be seen that in the prior art C.D. carburetor, the power throttle 20 is situated a considerable distance downstream of the metering rod 28 and the metering orifice 24. In comparison, the invention as depicted in, for example, FIG. 2, has the power throttle means 54 situated generally downstream of but in relatively close proximity to the metering rod means 88 and metering orifice 154. As generally depicted in FIG. 5, a partly closed power throttle 54 causes a constriction as at its upstream or forward end 300 which constriction, in turn, causes an increase in the velocity of air flow in such vicinity. The increase in air velocity, in turn, generates an increase in the magnitude of the vacuum in that area and such increase in the magnitude of the vacuum extends for some small distance upstream of the upstream or forward end 300 of power throttle valve 54. However, if the power throttle valve is completely open as shown in phantom line in FIG. 5, the power throttle valve will produce no such constricting effect on the in-flowing air.

Now with reference to FIG. 2, in the preferred embodiment of the invention, power throttle valve means 54, as depicted therein is formed and located as to beneficially employ the constrictive effects referred to with regard to the partly closed throttle of FIG. 5. In one successfully tested embodiment of the invention it was discovered that if the power throttle valve 54 were positioned so as to have the upstream side thereof at an angle of 8° below the longitudinal axis of the induction passage means and the downstream side thereof at an angle of 8° above the longitudinal axis of the induction passage means that such would cause a 5% increase in fuel enrichment of the delivered fuel-air mixture as compared to the mixture delivered when the power throttle valve means 54 was in a horizontal position parallel to the longitudinal axis of the induction passage means. As already hereinbefore at least implied, the magnitude of such enrichening is at least in part dependent upon the proximity of the edge of the upstream side of the power throttle valve 54 to the metering orifice 154 and, therefore, the tailoring of such fuel enrichment can be selectively increased or decreased by placing the throttle shaft 58 closer to or further away from the metering orifice means 154.

The arresting of further opening movement of the power throttle valve means 54 in order to have the throttle assume such an inclined position still, nevertheless, results in some engine power loss. For example, if the further opening of the power throttle valve 54 were thusly arrested when the power throttle assumed a position of 8° to 10° with respect to the longitudinal axis of the induction passage, the power loss would be in the range of approximately 1% to 2%. However, the preferred form of the invention, for all practical purposes eliminates even that small power loss. That is, as depicted in FIG. 2, in the preferred form, the power throttle valve 54 is formed as to have its downstream side assume a horizontal position, parallel to the longitudinal axis of the induction passage, when the upstream side thereof attains the desired angular inclination as, for example, 6° to 10° below the horizontal. It has been discovered that in such an arrangement no throttling effect occurs because the downstream side of the power throttle valve is aligned with the direction of air flow and the downwardly inclined upstream side of the throttle valve 54 produces no more flow area reduction than that produced by the power throttle valve half-shaft 58.

Distribution and Power Throttle Shaft

In C.D. carburetors both the idle and off-idle fuel is metered and discharged into the carburetor induction passage means upstream of the power throttle valve means. From there the fuel flows downstream impinging partly upon the power throttle valve, spreading over its surface, and ultimately flowing off the power throttle valve edges and into the engine intake manifold.

In some engines with low idle manifold vacuum, such as, for example, two-stroke engines or two cylinder motorcycle engines, idle and low range operation fuel distribution problems occur with prior art C.D. carburetors. Such will be explained as with reference to FIGS. 16 and 17 wherein elements which are like or similar to those of, for example, FIGS. 2–11 and 13–15 are identified with like reference numerals provided with suffixes "u" and "x", respectively.

Figure 16:
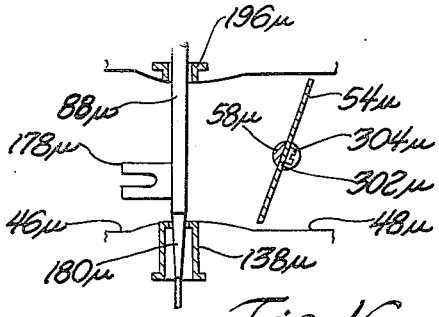
FIGS. 16 and 17, similar to each other, are each somewhat simplified representations of certain of the structure shown in, for example, FIG. 2, except that certain of the elements in FIGS. 16 and 17 are, generally, reversed from each other.

FIG. 16 illustrates what may be considered a conventional prior art arrangement of a power throttle valve 54*u* and its coacting shaft 58*u*. More particularly, the shaft 58*u* is of the "half-shaft" variety wherein the shaft is formed with an axially extending flatted surface 302*u* such that the throttle valve 54*u*, when mounted thereagainst is provided with a substantially flat and wide mounting surface and is geometrically situated as to be rotatable as about an axis of rotation passing through the medial plane of the throttle valve 54*u*. As is common practice, the throttle valve 54*u* is secured to the flatted surface 302*u* as by a plurality of screws 304*u*. It should be noted, however, that in FIG. 16 the flatted surface 302*u* is directed generally toward the outlet end 48*u* and that therefore the throttle valve 54*u* is situated relatively downstream of the shaft 58*u* when in a closed position. Such a prior art arrangement has been practiced because it was relatively easy to assemble the throttle valve to the shaft by applying the screws 304*u* from the outlet end 48*u*. It has been discovered that in such prior art arrangements, as depicted in FIG. 16, unless all dimensions, clearances, alignments etc are perfect, matched and perfectly centered (which is never the case) the fuel metered through the metering orifice 154 impinges upon the partly open power throttle valve 54*u* and, instead of flowing in the direction of the outlet 48*u*, collects along the juncture where the surface of the throttle valve 54*u* is first in contact with the throttle shaft 58*u*. From such juncture, which acts somewhat as a trough, the fuel flows, generally therealong to either end of the throttle shaft until it, in effect, passes the opposite edges of the throttle valve at which points the fuel flows into the induction passage and toward the outlet 48*u*. Since such flow along the juncture is never the same in both directions, the ultimate rate of fuel discharge at the opposite edges of the throttle valve is unequal resulting in significant problems of proper fuel distribution.

Figure 17:
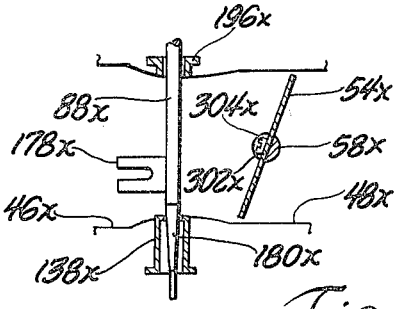

The teachings of one aspect of the invention eliminate such prior art fuel distribution problems. As depicted in FIG. 17, in the preferred form of the invention, the flatted surface 302*x* is directed generally toward the inlet 46 and the throttle valve 54*x* is assembled thereagainst as to be situated generally upstream thereof when in a closed position. As a consequence thereof, the metered fuel which strikes the partly opened throttle valve 54*x* can flow over the entire surface of the throttle valve 54*x*, without being in any way trapped or deflected by the upwardly protruding portion of the throttle shaft 58*x*, and continue to the downstream positioned edge of the throttle valve 54*x* for discharge to the outlet 48*x*. Accordingly, in the arrangement of FIG. 17 sideways flow of fuel (longitudinally of the shaft 58*x*) no longer occurs and is, instead, substantially centrally discharged to the outlet 48*x* thereby providing excellent partload fuel distribution.

Although only a preferred embodiment and selected alternate embodiments and modifications of the invention have been disclosed and described, it is apparent that other embodiments and modifications are possible within the scope of the appended claims.

What is claimed is:

1. A constant depression carburetor for a combustion engine, comprising carburetor body means, induction passage means formed by said body means, said induction passage means comprising an upstream air inlet end and a downstream fuel-air mixture outlet end, a fuel-air mixing region in said induction passage means generally between said inlet end and said outlet end, first and second rotatable throttle means in said induction passage means, said first throttle means being situated generally upstream of said fuel-air mixing region, said second throttle means being situated generally downstream of said mixing region, said second throttle means being effective for controlling the rate of discharge of said fuel-air mixture through said outlet end, fuel metering orifice means effective for discharging fuel into said fuel-air mixing region, metering rod means, said metering rod means comprising an axially extending contoured fuel metering portion, said metering rod means being situated generally transversely of said induction passage means as to pass generally through said mixing region and as to have said contoured fuel metering portion received by said fuel metering orifice means, pressure responsive motor means, said pressure responsive motor means comprising pressure responsive wall means, vacuum passage means, said vacuum passage means being effective for communicating the fuel-metering vacuum generated in said mixing region to one side of said pressure responsive wall means, said axially extending fuel metering portion being effective to cooperate with said fuel metering orifice means to thereby define varying effective metering orifice areas, and coupling means for operatively interconnecting said first throttle means, said pressure responsive movable wall means and said axially extending fuel metering portion, said coupling means comprising first connecting means operatively interconnecting said movable wall means and said axially extending fuel metering portion, said first connecting means permitting angular movement of said axially extending metering portion relative to said movable wall means, said coupling means further comprising second connecting means operatively interconnecting said first throttle means to said axially extending fuel metering portion, said second connecting means being effective to cause angular rotation of said first throttle means whenever said axially extending fuel metering portion moves axially while simultaneously permitting said axially extending fuel metering portion to have freedom of movement in directions generally transverse to the axial movement of said axially extending fuel metering portion.

2. A constant depression carburetor according to claim 1 wherein said first connecting means comprises lost motion means permitting translational motion of said metering rod means relative to said pressure responsive movable wall means.

3. A constant depression carburetor according to claim 1 wherein said pressure responsive movable wall means comprises diaphragm means.

4. A constant depression carburetor according to claim 1 wherein said pressure responsive movable wall means comprises diaphragm means having at least one annular convolution, and a diaphragm backing plate, said diaphragm backing plate comprising a generally outer wall surface of a conical configuration wherein the diameter of said conical configuration is generally larger as it extends from said diaphragm means.

5. A constant depression carburetor according to claim 1 wherein said pressure responsive wall means comprises piston means.

6. A constant depression carburetor according to claim 1 wherein said vacuum passage means comprises calibrated restriction means.

7. A constant depression carburetor according to claim 1 wherein said fuel metering orifice means is selectively adjustably positionable toward and away from the medial portion of said induction passage means.

8. A constant depression carburetor according to claim 1 wherein said fuel metering orifice means is selectively adjustably positionable toward and away from the medial portion of said induction passage means, and further comprising air-flow deflector means situated in said induction passage means downstream of said first throttle means and upstream of said fuel metering orifice means.

9. A constant depression carburetor according to claim 1 and further comprising air-flow deflector means extending into said induction passage means and situated downstream of said first throttle means and upstream of said fuel metering orifice means, and wherein said deflector means and said fuel metering orifice means are conjointly selectively adjustably positionable toward and away from the medial portion of said induction passage means.

10. A constant depression carburetor according to claim 1 and further comprising fuel reservoir chamber means for containing fuel to be metered through said fuel metering orifice means, a generally tubular member having a generally lower end thereof in communication with said fuel within said fuel reservoir chamber means, wherein said fuel metering orifice means is carried by said generally tubular member, spring means operatively engaging said generally tubular member and urging said generally tubular member axially toward the medial portion of said induction passage means, abutment surface means carried by said generally tubular member, and manually adjustable abutment means for cooperating with said abutment surface means for adjustably determining the axial distance toward said medial portion of said induction passage means to which said spring means is permitted to urge said generally tubular member.

11. A constant depression carburetor according to claim 1 and further comprising fuel reservoir chamber means for containing fuel to be metered through said fuel metering orifice means, a generally tubular member having a generally lower end thereof in communication with said fuel reservoir chamber means, wherein said fuel metering orifice means is carried by said generally tubular member, and additional calibrated restriction means carried by said generally tubular member as to at times present a restrictive effect on the flow of said fuel from said fuel reservoir chamber means into said generally tubular member.

12. A constant depression carburetor according to claim 1 wherein said first throttle means is situated relatively close to said fuel metering orifice means as to be effective to create a throttling effect upon any reverse flow through said induction passage means and thereby create an increase in the magnitude of the pressure in the vicinity of said fuel metering orifice means to thereby prevent the metering of additional fuel through said fuel metering orifice means during said reverse flow.

13. A constant depression carburetor according to claim 1 wherein said first throttle means comprises first throttle shaft means and first throttle valve means, and further comprising first and second bearing means carried by said carburetor body means for journalling said first throttle shaft means, wherein said bearing means are selectively movable relative to said carburetor body means and said first throttle shaft means for being able to selectively disengage from said first throttle shaft means, and clearance recess means formed in said induction passage means leading generally between said bearing means and said inlet end of said induction passage means.

14. A constant depression carburetor according to claim 1 wherein said first throttle means comprises a first pivotally rotatable throttle shaft extending transversely of said induction passage means, and a first throttle valve secured to said first throttle shaft for rotation therewith, said first throttle valve being secured to said first throttle shaft as to be disposed generally downstream thereof when in a closed condition.

15. A constant depression carburetor according to claim 1 wherein said first throttle means comprises a first pivotally rotatable throttle shaft extending transversely of said induction passage means, and a first throttle valve secured to said first throttle shaft for rotation therewith, said first throttle valve being formed to provide a channel-like recess thereacross, wherein said first throttle valve is secured to said first throttle shaft in a manner whereby said first throttle shaft is generally received by said channel-like recess and said first throttle valve is disposed generally downstream of said first throttle shaft when in a closed condition, and wherein said first throttle valve is welded to said first throttle shaft.

16. A constant depression carburetor according to claim 1 wherein said second throttle means comprises a rotatable throttle valve having a generally upstream directed throttle valve portion and a generally downstream directed throttle valve portion when in a wide open condition, and wherein said upstream directed throttle valve portion is inclined at least by 6° with respect to the longitudinal axis of said induction passage means when said throttle valve is in said wide open condition.

17. A constant depression carburetor according to claim 1 wherein said second throttle means comprises a rotatable throttle valve having a generally upstream directed throttle valve portion and a generally downstream directed throttle valve portion when in a wide open condition, wherein said upstream directed throttle valve portion is inclined at least by 6° with respect to the longitudinal axis of said induction passage means when said throttle valve is in said wide open condition, and wherein said downstream directed throttle valve portion is generally parallel to the longitudinal axis of said induction passage means when said throttle valve is in said wide open condition.

18. A constant depression carburetor according to claim 1 wherein said second throttle means comprises a pivotally rotatable throttle shaft extending generally transversely of said induction passage means, and a throttle valve secured to said throttle shaft for rotation therewith, said throttle shaft comprising an axially extending flatted mounting surface with the plane of said mounting surface being at least close to the axis of rotation of said throttle shaft, wherein said throttle valve is fixedly secured to said throttle shaft operatively against said flatted mounting surface, and wherein said throttle valve is disposed generally upstream of said flatted mounting surface when said throttle valve is rotated to a closed condition.

19. A constant depression carburetor according to claim 1 wherein said pressure responsive movable wall means defines first and second pressure chamber means at opposite sides thereof, wherein said vacuum passage means communicates with said first pressure chamber means, wherein said second pressure chamber means communicates with a source of atmospheric pressure, and further comprising guide means carried by said carburetor body as to be generally interposed between said second pressure chamber means and said induction passage means, said guide means comprising guide passage means extending therethrough, said metering rod means extending through said guide passage means, and wherein said guide passage means is of a size and configuration permitting said metering rod means to freely move axially and translationally therein.

20. A constant depression carburetor according to claim 1 and further comprising fuel reservoir chamber means for containing fuel to be metered through said fuel metering orifice means, first passage means for communicating between a source of atmospheric pressure and said fuel reservoir chamber means, second passage means comprising first calibrated restriction means for communicating between a source of atmospheric pressure and said fuel reservoir chamber means, and third passage means comprising second calibrated restriction means for communicating between a source of vacuum in said mixing region of said induction passage means and said fuel reservoir chamber means, said third passage means being effective to reduce the magnitude of the pressure within said fuel reservoir chamber means depending upon the magnitude of the vacuum generated in said mixing region and on the degree of restrictive effect exhibited by said first calibrated restriction means as well as the degree to which said first passage means freely communicates atmospheric pressure.

21. A constant depression carburetor according to claim 1 and further comprising fuel reservoir chamber means for containing fuel to be metered through said fuel metering orifice means, wherein said pressure responsive movable wall means defines first and second pressure chamber means at opposite sides thereof, wherein said vacuum passage means communicates with said first pressure chamber means, wherein said second pressure chamber means communicates with a source of atmospheric pressure, first passage means for communicating between a source of atmospheric pressure and said fuel reservoir chamber means, second passage means comprising first calibrated restriction means communicating between said second pressure chamber means and said fuel reservoir chamber means, third passage means comprising second calibrated restriction means for communicating between a source of vacuum in said mixing region and said fuel reservoir chamber means, said third passage means being effective to reduce the magnitude of the pressure within said fuel reservoir chamber means depending upon the magnitude of the vacuum generated in said mixing region and on the degree of restrictive effect exhibited by said first calibrated restriction means as well as the degree to which said first passage means freely communicates atmospheric pressure, and means responsive to indicia of engine operation for at times at least reducing the degree of communication of atmospheric pressure through said first passage means.

22. A constant depression carburetor according to claim 1 wherein said metering rod means comprises an elongated cylindrical main body portion operatively connected at one end to said pressure responsive movable wall means and at an end opposite to said one end carrying said contoured fuel metering portion as an axial extension thereof.

23. A constant depression carburetor according to claim 1 wherein said metering rod means comprises an elongated thin plate-like main body operatively connected at one end to said pressure responsive movable wall means and at an end opposite to said one end carrying said contoured fuel metering portion as an extension thereof.

24. A constant depression carburetor according to claim 1 wherein said first connecting means comprises first and second retainer members combining to form a retainer chamber generally therebetween, a clearance aperture formed in said first retainer member for permitting the free passage therethrough of an end of said metering rod means, and a third retainer in lost-motion engagement with said end of said metering rod means, said third retainer and said metering rod means being capable without disengagement of angular and translational motion relative to each other, said third retainer being received within said retainer chamber so as to be capable of experiencing lostmotion relative to said first and second retainer members.

25. A constant depression carburetor according to claim 24 wherein said first and second retainer members are contained in assembled relationship and carried by said movable wall means.

26. A constant depression carburetor according to claim 1 wherein said first connecting means comprises a flexible extension carried by said pressure responsive movable wall means and operatively connected to one end of said metering rod means.

27. A constant depression carburetor according to claim 1 wherein said first connecting means comprises an elongated slot carried by one end of said metering rod means, and a pivot pin operatively carried by said pressure responsive movable wall means, said pivot pin extending through said elongated slot as to have said one end of said metering rod free to move relative to said pivot pin both axially along said pivot pin and along the length of said elongated slot as well as angularly about the axis of said pivot pin.

28. A constant depression carburetor according to claim 1 wherein said second connecting means comprises fulcrum means carried by said first throttle means, and an elongated slot carried by said metering rod means, said fulcrum means being received by said slot so that axial motion of said metering rod means results in rotational movement of said first throttle means and rotation of said first throttle means results in axial motion of said metering rod means.

29. A constant depression carburetor according to claim 1 wherein said second connecting means comprises first fulcrum means carried by said first throttle means, second fulcrum means carried by said metering rod means, and pivotal linkage means interconnecting said first fulcrum means to said second fulcrum means.

30. A constant depression carburetor according to claim 1 wherein said second connecting means comprises spring means effectively connected at one end to said first throttle means and effectively connected as at an other end to said metering rod means.

31. A constant depression carburetor according to claim 30 wherein said spring means is also effective for resiliently urging said metering rod means generally translationally downstream of said first throttle means.

32. A constant depression carburetor according to claim 30 wherein said spring means is of a generally U-shaped configuration having one leg thereof operatively connected to said first throttle valve means and having the other leg thereof operatively connected to said metering rod means.

33. A constant depression carburetor according to claim 30 wherein said spring means is of a generally torsional configuration having extending torsion arms, wherein one of said torsion arms is operatively connected to said first throttle means, and wherein an other of said torsion arms is operatively connected to said metering rod means.

34. A Constant Depression carburetor for an OTTO cycle engine comprising:

(a) a carburetor body including at least one main passage, said passage beginning with an air inlet which connects to a fuel mixing region which leads to a mixture outlet;

(b) two throttle plates disposed in said passage, one upstream of said fuel mixing region (hereafter called C.D. throttle) and one downstream from said fuel mixing region (hereafter called power throttle);

(c) a fuel metering orifice discharging into said fuel mixing region;

(d) a tapered meteringrod controlling the flow area of said fuel metering orifice and traversing said fuel mixing region and exiting through the wall opposite of said fuel metering orifice;

(e) a device acting as a piston arranged substantially concentric with said meteringrod, said piston moving in a housing and being subjected to suction on its side opposite to sad meteringrod;

(f) a suction passage connecting said suction side of said piston with said fuel mixing region; and (g) means to oppose the piston movement caused by said suction connection, these means consisting of a spring;

(h) the improvement embodied by a coupling between said piston and said meteringrod which comprises means to transmit axial movement and at the same time permitting both angular and lateral freedom of relative movement between said piston and said meteringrod;

(i) the improvement furthermore embodied by a linkage attached to the side of said meteringrod inside the mixture passage, said linkage being hinged to an arm which is attached to said C.D. throttle, said hinged linkage being designed to transmit axial movement to said metering rod and at the same time permitting lateral freedom of movement between said meteringrod and said arm;

(j) the improvement creating a triple connection which moves said piston, said meteringrod and said C.D. throttle in unison, being jointly driven by a common linkage device of low airodynamic resistance which is placed inside said fuel mixing region.

35. The carburetor of claim 34 wherein its metering parts being arranged in such a manner that the fuel-air ratio enrichment at low numbers of revolutions and wide open power throttle (which ordinarily results from the reverse mixture flow conditions occuring during the exhaust and intake opening overlap period) will be compensated for by a mixture weakening effect, said weakening effect being created by arranging the metering orifice at a distance downstream of the C.D. throttle which is selected to expose said orifice to a pressure surge during reverse mixture flow, said pressure surge being created by the daming effect caused by the C.D. throttle for reverse mixture flow conditions, in combination with a selection of the power of the C.D. spring which keeps said C.D. throttle partially closed at low numbers of revolution, wide open power throttle in order to cause said pressure surge.

36. The carburetor of claim 34 in which said linkage consists of a "U" shaped spring attached to the side of said meteringrod, a pin attached to said C.D. throttle-arm, said spring engaging said pin.

37. The carburetor of claim 34 in which said linkage consists of a bearing attached to the side of said meteringrod, a second bearing attached to said throttle arm and a strip shaped connecting rod between said two bearings.

38. The carburetor of claim 34 in which the guide for the meteringrod is located at the point where said meteringrod exits through the wall of said fuel mixing region, said meteringrod guide being provided with a clearance sufficient to permit angular freedom of said meteringrod inside its orifice, the air leakage resulting from said clearance being rendered harmless by means of at least one atmospheric vent connecting to the space under said piston device, the area of said vent being a large multiple of said air leakage area.

39. The carburetor of claim 34 with an axially adjustable fuel metering orifice assembly, as inclined adjustment screw, arranged in the carburetor body, said adjustment screw exiting from said body above the gasket surface located between said body and the fuel bowl in such a manner that fuel can not leak out at said exit point, said adjustment screw impinging on a conical collar which is provided on said fuel metering orifice assembly.

40. The carburetor of claim 34 in which said powerthrottle is arranged in close proximity to said fuel orifice, said powerthrottle rotating for opening with its lower edge towards said fuel orifice, the maximum opening of said powerthrottle throttle being limited to at least 6° before the wide open position, so that the resulting inclined open throttle position, in conjunction with its proximity to the fuel orifice, provides a Venturi effect which results in full power enrichment, this said powerthrottle being bent on the exit side, in such a manner that the exit half of said powerthrottle will be in the maximum wide open position while the fronthalf is still somewhat closed, thus reducing the throttling effect of the incomplete opening of said powerthrottle to an inconsequential amount.

41. The carburetor of claim 34 with said powerthrottle being attached to a half shaft, the flat side of said half shaft facing the fuel mixing region in the idle and low range positions, so that the fuel droplets impinging on said power-throttle will spread along the throttle plate face without being prevented from evenly spreading by an obstructing shaft.

42. The carburetor of claim 34 in which said linkage consists of a plate attached to the side of said meteringrod, said plate being provided with a slot, a shaft pin attached to said C.D. throttle arm, said shaft pin forming a pivot movable inside said slot.

43. The carburetor of claim 42 in which the shaft of said meteringrod is formed by a flat plate which contains both said slot and said coupling to said piston.

44. The carburetor of claim 43 in which said coupling to said piston consists of a pin which engages a second slot in said flat plate, said pin being held by a ring which leaves clearance for sideways movement of said flat plate, said ring being held in an elastic cavity which is shaped as the negative of the outside of said ring, said elastic cavity being formed in one piece with the centerpart of said piston.

45. The carburetor of claim 34 in which an air-deflecting shield is arranged upstream of said fuel metering orifice in close proximity to said fuel metering orifice, said air-deflecting shield being dimensioned and located in such a manner that it causes a suction increase on said metering orifice, this suction increase occuring mostly over the region of C.D. throttle opening angles where the directional deflection of the partly opened C.D. throttle would cause (without said deflector shield) a metering suction decrease, said deflector shield thus compensating for said metering suction decrease.

46. The carburetor of claim 45 in which said air-deflecting shield is attached to an axially adjustable fuelmetering orifice assembly so that the suction and vortex creating ability of said shield will remain unchanged, with changed adjustment elevation of said orifice.

47. The carburetor of claim 45, possessing four features, which are dimensioned and put into relative position to each other in such a manner that, in combination, they generate an airflow and a metering suction in the idle and low load range, the magnitude of which is matched to the fuel flow generated by a nearly straight taper of said meteringrod, these four features being (first) the initial closing angle of said C.D. throttle (second) the angle of the radial which connects the C.D. throttle pivot center to said shaft pin (third) the distance between said C.D. throttle and said metering orifice and (fourth) the height and location of said deflector shield.

48. The carburetor of claim 34 in which said C.D. throttle forms an integral unit with its shaft, the ends of said shaft being suspended in two removable bearings, said bearings intersecting two grooves which extend from the carburetor inlet to said bearings, said grooves being dimensioned in such a manner that said C.D. throttle-shaft integral unit can be slid out of the carburetor body after the removal of said two bearings.

49. The carburetor of claim 48, in which said integral C.D. throttle shaft unit and said linkage and said coupling to the diaphragm and said central disk are designed for minimal mass, so that oscillation of the system after sudden flow changes is greatly reduced, said mass reduction of the C.D. throttle being accomplished by providing a thin C.D. throttle plate with a channel in which a slender throttle shaft nests, said channel surrounding said shaft on the downstream side, as a result of which engine backfires will push said channel against said shaft, said mass reduction being furthermore accomplished by means of thin gage members of the linkage, said mass reduction being furthermore accomplished by proper design and light weight material selection for said coupling to the diaphragm and said central disk, said oscillation furthermore being reduced by selecting a large ratio of diaphragm area to the mass of said movable metering parts.

50. The carburetor of claim 34 in which said piston is formed by a free floating diaphragm without a guide other than provided by said opposing spring, said spring being dimensioned to be under the buckling limit.

51. The carburetor of claim 50 in which said free floating diaphragm carries a central disk which is inserted between said diaphragm and said spring, a convolution formed in said diaphragm outside said disk, said disk carrying a cone shaped rim on which said convolution is rolling off during the diaphragm travel, said cone shaped rim being provided with a cone angle selected to support and guide the inner part of said convolution in a manner counteracting tilting of said diaphragm.

52. The carburetor of claim 50 in which said free floating diaphragm is formed in one piece with an elastic rod shaped extension which is connected at its free end to said meteringrod.

53. The carburetor of claim 50 wherein said linkage consists of a plate attached to the side of said meteringrod, said plate being provided with a slot, a shaft pin attached to said C.D. throttle arm, said shaft pin forming a pivot movable inside said slot, wherein said piston is formed by a free floating diaphragm without a guide other than provided by said opposing spring, said spring being dimensioned to be under the buckling limit, and wherein the shaft of said meteringrod is formed by a flat plate which contains both said slot and said coupling to said diaphragm.

54. The carburetor of claim 53 in which said coupling to said diaphragm consists of a pin which engages a second slot in said flat plate, said pin being held by a ring which leaves clearance for sideways movement of said flat plate, said ring being held in an elastic cavity which is shaped as the negative of the outside of said ring, said elastic cavity being formed in one piece with the centerpart of said diaphragm.

55. The carburetor of claim 50 in which the said coupling between said diaphragm and said meteringrod consists of an "E" ring loosly engaging a groove in the meteringrod, said "E" ring fitting with its outer perimeter into a diskshaped pocket which permits lateral movement of said "E" ring.

56. The carburetor of claim 55 in which said diskshaped pocket is formed inside a diskshaped container which is composed by at least two parts, said container being attached to said diaphragm by being slipped into an elastic cavity which is the negative of the shape of said container, said elastic cavity being formed in one piece with the center part of said diaphragm.

* * * * *

UNITED STATES PATENT AND TRADEMARK OFFICE

CERTIFICATE OF CORRECTION

PATENT NO. : 4,323,521

DATED : April 6, 1982

INVENTOR(S) : Henri Morgenroth

It is certified that error appears in the above—identified patent and that said Letters Patent is hereby corrected as shown below:

Column 14, line 64, change "contenically" to --- continually ---.

Column 14, line 65, change "an" to --- can ---.

Claim 24, line 13 thereof, change "lostmotion" to --- lost-motion ---.

Claim 39, line 2 thereof, change "as" to --- an ---.

Claim 40, line 5 thereof, after "powerthrottle" delete --- throttle ---.

Signed and Sealed this

*Third* Day of *August 1982*

[SEAL]

*Attest:*

GERALD J. MOSSINGHOFF

*Attesting Officer* *Commissioner of Patents and Trademarks*